US005979544A

United States Patent [19]

Inoue

[11] Patent Number: 5,979,544

[45] Date of Patent: Nov. 9, 1999

[54] LAMINATED HEAT EXCHANGER

[75] Inventor: Seiji Inoue, Konan, Japan

[73] Assignee: Zexel Corporation, Tokyo, Japan

[21] Appl. No.: 08/942,685

[22] Filed: Oct. 2, 1997

[30] Foreign Application Priority Data

Oct. 3, 1996 [JP] Japan ..... 8-281881
Oct. 3, 1996 [JP] Japan ..... 8-281882

[51] Int. Cl.[6] ..... F28D 1/02

[52] U.S. Cl. ..... 165/153; 165/174; 165/176

[58] Field of Search ..... 165/176, 153, 165/174

[56] References Cited

U.S. PATENT DOCUMENTS

| | | | |
|---|---|---|---|
| 4,696,342 | 9/1987 | Yamauchi et al. | 165/153 |
| 4,800,954 | 1/1989 | Noguchi et al. | 165/153 |
| 5,617,915 | 4/1997 | Kinugasa et al. | 165/153 |
| 5,620,047 | 4/1997 | Nishishta | 165/153 |
| 5,630,473 | 5/1997 | Nishishita | 165/176 |
| 5,645,126 | 7/1997 | Nishishta et al. | 165/153 |
| 5,649,592 | 7/1997 | Nishishita | 165/176 |
| 5,667,007 | 9/1997 | Nishishita | 165/153 |
| 5,701,760 | 12/1997 | Torigoe et al. | 165/153 |

FOREIGN PATENT DOCUMENTS

| | | | |
|---|---|---|---|
| 4-43294 | 2/1992 | Japan | 165/153 |
| 5-87482 | 4/1993 | Japan | 165/153 |

*Primary Examiner*—Ira S. Lazarus
*Assistant Examiner*—Terrell McKinnon
*Attorney, Agent, or Firm*—Wenderoth, Lind & Ponack, L.L.P.

[57] ABSTRACT

In a heat exchanger formed by laminating tube elements alternately with fins over a plurality of levels, a plurality of beads are formed in each of tube elements provided with intake/outlet portions in the areas where the tank portions change to a passage portion. The width of these beads are set to be larger than the beads in other tube elements so as to constrict the passage cross section. In addition, the areas of the communicating holes formed in tank portions away from the intake/outlet portion through which the heat exchanging medium flows in are made smaller than the areas of the communicating holes formed in tank portions near the intake/outlet portion. The centers of the communicating holes in the tank portions further away from the intake/outlet portion are located further downward than the centers of the communicating holes in the tank portions provided closer to the intake/outlet portion. The distribution of the heat exchanging medium is made more consistent to reduce inconsistency in the temperature among individual tube elements in order to achieve good heat exchange.

28 Claims, 19 Drawing Sheets

LAMINATED HEAT EXCHANGER

BACKGROUND OF THE INVENTION

1. Field of the Invention

The present invention relates to a laminated heat exchanger that is employed in an air conditioning system or the like mounted in vehicles, and is constituted by laminating tube elements, each provided with tank portions and a passage portion, alternately with fins over a plurality of levels.

2. Description of the Related Art

In the prior art, tube elements in a so-called drawn cup type laminated heat exchanger are each constituted by bonding two formed plates face-to-face and are each provided with tank portions where heat exchanging medium collects and is distributed and a passage portion communicating with the tank portions. The passage portion is provided with. a number of beads formed therein for promoting heat exchange. Furthermore, shoal-like beads are formed in the areas where the tank portions change or transition into the passage portion. In addition, intake/outlet portions, which project out and open from tank portions so as to be connected with piping, are formed in specific tube elements.

However, a heat exchanger structured as described above has problems in that, since the heat exchanging medium flows in and out through piping connected at specific tank portions, the passage resistance is reduced in the tube elements where the intake/outlet portions are formed by an amount corresponding to the quantity of heat exchanging medium that does not travel through the other tank portions. Also, depending upon the type of heat exchanger, these tube elements may constitute the shortest path and, in particular, when the flow rate is low, the flow concentrates in the tube elements provided with the intake/outlet portions, which adversely affects the temperature distribution in the heat exchanger.

For instance, in the case of a unilateral tank type evaporator which is known in the prior art, it has been confirmed that, as shown in FIG. 4A, the surface temperature at the tube elements provided with the intake/outlet portions, which is indicated by the filled circles, is lower than the temperature at the other tube elements, with the temperature becoming higher in the tube elements further away from the intake/outlet portions. This results in an increase in the difference ($\Delta T$) in the surface temperature between the tube elements where the temperature is the highest and the tube elements where the temperature is the lowest (the tube elements provided with the intake/outlet portions in the prior art).

In addition, a unilateral tank type laminated heat exchanger which, in order to improve heat exchanging performance, is achieved by reducing the inconsistency in the air temperature distribution of the air passing through the heat exchanger in the prior art is disclosed in Japanese Unexamined Patent Publication No. S 63-3153.

In this laminated heat exchanger, which is constituted by laminating passage units (tube elements) alternately with corrugated fins over a plurality of levels, the passage units are each provided with a pair of tanks, i.e., a first tank and a second tank at one side, with a U-shaped coolant passage (U-shaped passage) communicating between the pair of tanks and a first communicating hole (communicating hole) or a second communicating hole (communicating hole) at each tank. Thus, when the tanks in adjacent passage units are bonded together, two tank groups are formed extending in the direction of the lamination (a first tank group and a fourth tank group, a second tank group and a third tank group). The first tank group and the fourth tank group are partitioned in the middle so that they do not communicate with each other. An intake pipe is mounted at the first tank group and an outlet pipe is mounted at the fourth tank group. In addition, in the third tank group, one or two passage units provided with a constricting portion having a constricting hole with a diameter smaller than that of the second communicating hole is provided to partially reduce the flow passage area for the coolant.

According to the publication, the constricting portion formed within the third tank group prevents the liquid coolant flowing within the third tank group from flowing fast. As a result, the liquid coolant is prevented from flowing far into the third tank group in a great quantity, which, in turn, causes the liquid coolant to flow in ample quantity into the passage units communicating with tanks in the middle and toward the frontmost area among the tanks constituting the third tank group, thereby achieving consistency in the quantity of the liquid coolant flowing throughout.

However, if the flow rate of heat exchanging medium in a liquid form is restricted simply by providing a constricting portion in a specific tank group, as in the prior art heat exchanger described above, when the heat exchanging medium in a liquid form is flowing at a low flow rate, it will be inhibited more than necessary by the constricting portion, thus preventing the heat exchanging medium in a liquid form from being thoroughly distributed throughout the tanks further inward relative to the intake/outlet portions in the tank groups provided with the intake/outlet portions, so as to adversely affect the temperature distribution even more.

SUMMARY OF THE INVENTION

Accordingly, an object of the present invention is to provide a laminated heat exchanger that achieves good heat exchanging performance by reducing the inconsistency in the surface temperatures at the individual tube elements. Another object of the present invention is to provide a laminated heat exchanger with which, when the flow rate of the heat exchanging medium is high, the heat exchanging medium is inhibited from flowing in great quantity into the tanks positioned further inward of a tank group communicating with the tank group into which the heat exchanging medium flows from the outside or with an adjacent tank group only through communicating holes by reducing the flow path area for the heat exchanging medium. Further, when the flow rate of the heat exchanging medium is low, it is possible to avoid the situation in which the heat exchanging medium cannot reach the tanks positioned further inward in the tank group communicating with the tank group into which the heat exchanging medium flows from the outside or with the adjacent tank group only through the communicating holes, even with the flow of the heat exchanging medium restricted.

The inventor of the present invention has completed the present invention based upon the observation that since, in a prior art heat exchanger, all of the tube elements have basically the same shape in the area where they change from the tank portions to the passage portion. Therefore, if the tube elements with the lowest passage resistance, which also constitute the shortest path, are provided with the intake/outlet portions, good dispersion of the heat exchanging medium can be achieved to improve the temperature distribution by reducing the flow path cross section in the area where the tube element changes from the tank portions to the passage portion so as to increase the passage resistance.

The inventor of the present invention also observed that, in a prior art heat exchanger, the communicating holes formed in the tank portions are shaped identically in all of the tube elements, which results in inconsistent distribution of the heat exchanging medium. Therefore, good dispersion of the heat exchanging medium can be achieved to improve the temperature distribution by adjusting the area of the communicating holes in relation to the inflow position of the coolant.

The laminated heat exchanger, according to the present invention, is constituted by laminating tube elements, each of which is provided with tank portions and a passage portion formed continuous to the tank portions, over a plurality of levels, with adjacent tube elements made to communicate with each other with the tank portions abutted to each other and fins provided between the passage portions. In some of the tube elements, intake/outlet portions, which project out and open from the tank portions are formed and, in these tube elements, the passage cross section of the areas where the tank portions change to the passage portions are reduced relative to that in other tube elements.

In a specific structural example, the passage cross section in the areas where the tank portions change to the passage portion are reduced in a tube element provided with an intake/outlet portion compared to that in the other tube elements. Beads are formed for partitioning the areas where the tank portions change to the passage portion, and the passage cross section is constricted by setting the width of these beads larger than the width of the beads in the other tube elements. In this example, the width of all of the beads may be enlarged in the areas where the tank portions change to the passage portion or the width of only some of the beads may be enlarged. In addition, the number of beads in this area does not have to be the same as the number of beads in the corresponding areas in other tube elements, and a bead structure may be adopted in which the overall passage area is reduced by forming a smaller number of wide beads.

The laminated heat exchanger in this example may be of the so-called unilateral tank type, which is provided with tank portions only at one side of the tube elements, or of the bilateral tank type, in which tank portions are formed at both sides of the tube elements. Furthermore, the structure, which achieves a reduction of the passage cross section at the areas where the tank portions change to the passage portion may be adopted only at the tube element at the side where the heat exchanging medium is taken in, or it may be adopted only at the tube element at the outlet side or it may be adopted at both the intake side and the outlet side.

Consequently, the heat exchanging medium flowing in through an intake/outlet portion will tend to flow by traveling through the passage portions with the lowest passage resistance, thus forming the shortest path length. However, since, in the tube elements provided with the intake/outlet portions, the areas where the tank portions change to the passage portion are constricted so as to have a smaller passage cross section compared to that of the other tube elements, the heat exchanging medium is prevented from flowing in a concentrated manner in this area and is made to flow almost consistently through the individual tube elements.

In addition, in a laminated heat exchanger constituted by laminating tube elements, each of which is provided with a pair of tanks at the bottom portion and a U-shaped passage communicating between the pair of tanks, alternately with fins over a plurality of levels so that two tank groups are formed extending in the direction of the lamination by connecting the tanks in adjacent tube elements via communicating holes provided at the sides thereof with either one or both of the tank groups partitioned as necessary to be divided into a plurality of smaller tank groups in such a manner that, after the heat exchanging medium flows into one of the smaller tank groups from the outside, it flows sequentially to the adjacent smaller tank groups through the U-shaped passages and the communicating holes to flow out to the outside from the last of the smaller tank groups that it reaches. The communicating holes in the tanks positioned further inside relative to the inflow position of the smaller tank group, into which the heat exchanging medium flows from the outside, may be formed to have a smaller flow passage area than that of the communicating holes of the other tanks constituting the smaller tank groups and may also be positioned further downward than the other communicating holes.

It is to be noted that the heat exchanger may be constituted in such a manner that the tanks located further toward the front relative to the inflow position in the smaller tank group into which the heat exchanging medium flows from the outside are provided with communicating holes formed further downward, as in the case with the tanks located further inside, and that they are further provided with communicating holes above those communicating holes, or are provided with communicating holes with a larger flow path area than that of the communicating holes formed further downward in the tanks located further inward.

With this, when the flow rate of liquid heat exchanging medium is high, since the flow passage area of the communicating holes in the tanks located further inward relative to the inflow position in the smaller tank group into which the heat exchanging medium flows from the outside is smaller than that of the communicating holes of the other tanks, the flow rate of the heat exchanging medium is controlled so as to prevent a large quantity of heat exchanging medium from flowing into the tanks located further inward due to the force of inertia. This arrangement makes it possible to deliver the heat exchanging medium into the U-shaped passages communicating with the tanks in the vicinity of the inflow position in a sufficient quantity.

Then, when the flow rate of the liquid heat exchanging medium is low, since the communicating holes of the tanks located further inward relative to the inflow position in the smaller tank group into which the heat exchanging medium flows from the outside are formed at positions further downward than the communicating holes of the other tanks constituting the smaller tank group, the heat exchanging medium that flows at a low flow rate along the lower side of the tanks can be guided to the tanks located further inward through the communicating holes.

In addition, in the laminated heat exchanger which is constituted by laminating tube elements, each of which provided with a pair of tanks at the bottom portion and a U-shaped passage communicating between the pair of tanks, alternately with fins over a plurality of levels so that two tank groups are formed extending in the direction of the lamination by connecting the tanks in adjacent tube elements via communicating holes provided at the sides thereof, with either one or both of the tank groups partitioned as necessary to be divided into a plurality of smaller tank groups in such a manner that, after the heat exchanging medium flows into one of the smaller tank groups from the outside, it flows sequentially into the adjacent smaller tank groups through the U-shaped passages and the communicating holes to flow out so as to the outside from the last of the smaller tank group that it reaches. The communicating holes, in the tanks positioned further inside relative to the inflow position of a smaller tank group into which the heat exchanging medium flows via the communicating holes from the adjacent tank group in the direction of the lamination, are formed so as to have a smaller flow passage area than that of the communicating holes in the other tanks constituting the smaller tank group and at positions further downward than the other communicating holes.

It is to be noted that the heat exchanger may be constituted in such a manner that the tanks located in the vicinity of the inflow position in the smaller tank group into which the heat exchanging medium flows via the communicating holes in the adjacent smaller tank group in the direction of the lamination are provided with communicating holes formed further downward, as in the case with the communicating holes in the tanks located further inside, and they are further provided with communicating holes above those communicating holes. The heat exchanger may alternatively be constructed in such a manner that the tanks, located close to the inflow position, are provided with communicating holes with a larger flow path area than that of the communicating holes formed further downward in the tanks located further inward.

With this, when the flow rate of the liquid heat exchanging medium is high, since the flow passage area of the communicating holes in the tanks located further inward relative to the inflow position in the smaller tank group into which the heat exchanging medium flows via the communicating holes from the adjacent smaller tank group in the direction of the lamination is smaller than that of the communicating holes of the other tanks, the flow rate of the heat exchanging medium is controlled to prevent a large quantity of heat exchanging medium from flowing into the tanks located further inward due to its inertia. Thus, it is possible to deliver the heat exchanging medium into the U-shaped passages communicating with the tanks in the vicinity of the inflow position in sufficient quantity.

Then, when the flow rate of the liquid heat exchanging medium is low, since the communicating holes of the tanks located further inward relative to the inflow position in the smaller tank group into which the heat exchanging medium flows via the communicating holes from the adjacent smaller tank group in the direction of the lamination are formed at positions further downward than the communicating holes of the other tanks constituting the smaller tank group, the heat exchanging medium that flows at a low flow rate along the lower side of the tanks can be guided to the tanks located further inward through the communicating holes.

Furthermore, the features of the laminated heat exchangers described above may be combined to achieve a further improvement in consistency in the distribution of heat exchanging medium.

BRIEF DESCRIPTION OF THE DRAWINGS

The above and other features of the invention and the concomitant advantages will be better understood and appreciated by persons skilled in the field to which the invention pertains in view of the following description provided in conjunction with the accompanying drawings which illustrate preferred embodiments. In the drawings.

DETAILED DESCRIPTION OF THE PREFERRED EMBODIMENTS

Figure 1:
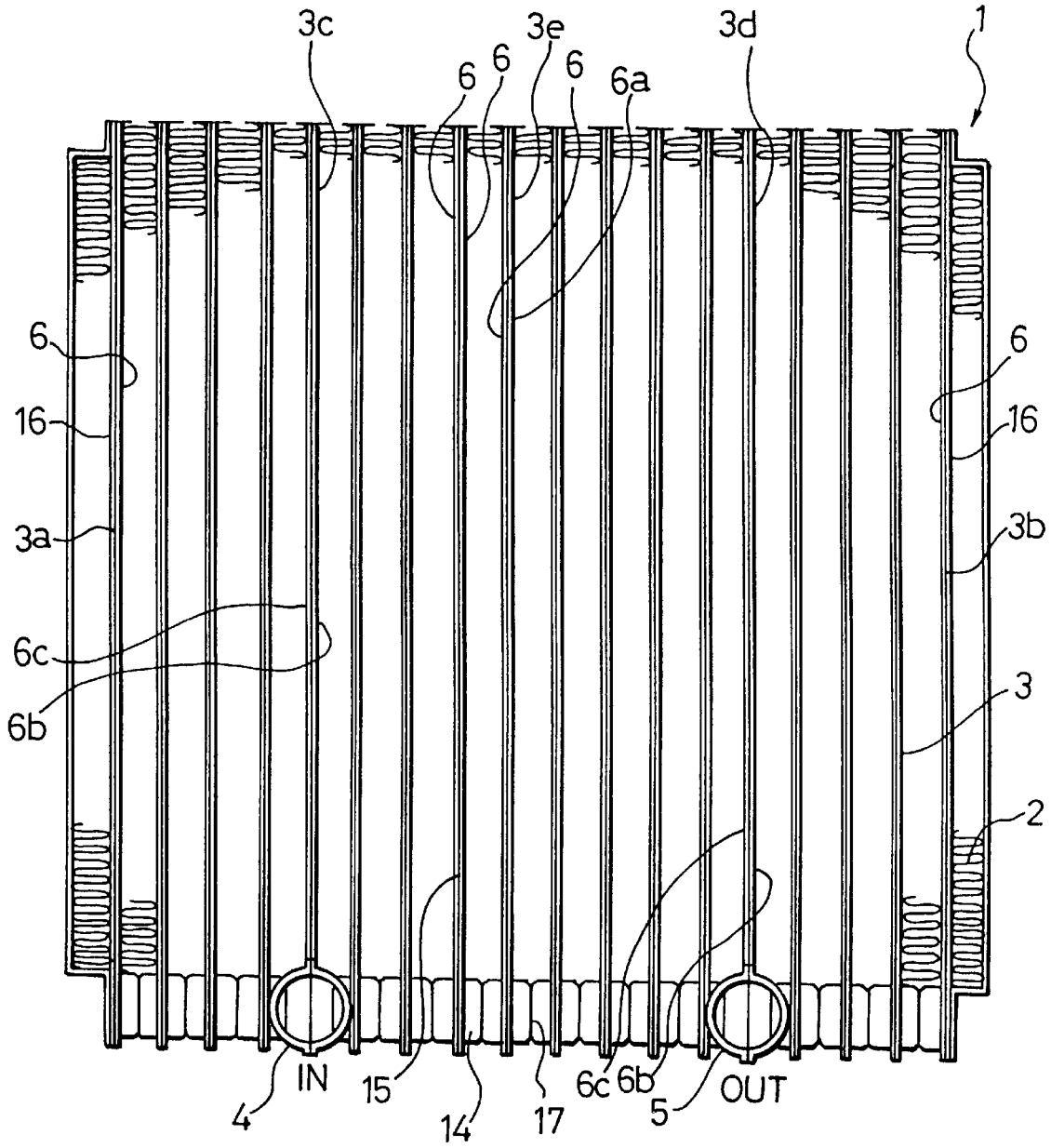
FIG. 1 is a front view of a unilateral tank type laminated heat exchanger according to the present invention.

The following is an explanation of preferred embodiments of the present invention in reference to the drawings. In FIG. 1, a laminated heat exchanger 1, which is an evaporator employed in an air conditioning system for vehicles and the like, may be, for instance, a 4-pass heat exchanger with fins 2 and tube elements 3 laminated alternately over a plurality of levels to form a core main body with intake/outlet portions 4 and 5 for coolant provided in specific tube elements. The tube elements 3 are each constituted by bonding face-to-face two formed plates 6, one of which is illustrated in FIG. 2A, except for tube elements 3*a* and 3*b* at the two ends of the heat exchanger in the direction of the lamination, tube elements 3*c* and 3*d* where the intake/outlet portions are formed and a tube element 3*e* located approximately at the center of the heat exchanger.

This formed plate 6 itself is of the known art which is formed by press machining an aluminum plate, and is provided with two bowl-shaped distended portions for tank formation 7 formed at one end and a distended portion for passage formation 8 continuous thereto. In the distended portion for passage formation 8, cylindrically shaped beads 9 are formed as an integrated part thereof with specific regularity and a projection 10 is also formed as an integrated part thereof extending from the area between the distended portions for tank formation 7 to the vicinity of the other end of the formed plate. In addition, the distended portions for tank formation 7 are formed so as to distend to a greater degree than the distended portion for passage formation 8 with a communicating hole 11 formed in each distended portion. Also, in each of the areas where the distended portions for tank formation 7 change into the distended portion for passage formation 8, three shoal-like beads 12 (hereafter referred to as shoal-like beads) are formed so as to extend in the lengthwise direction of the formed plate 6.

The beads 9 and 12 and the projection 10 are all formed so that they rise to the same plane as a bonding margin 13 at the peripheral edges of the formed plate, and when two formed plates 6 are bonded at their peripheral edges, the beads 9 and 12 and the projections 10 also become bonded so that a pair of tank portions 14 are formed by the distended portions for tank formation 7 that confront each other. Also, a U-turn passage portion 15, which connects between the tank portions, is formed with the distended portions for passage formation 8 that confront each other.

Figure 2A:
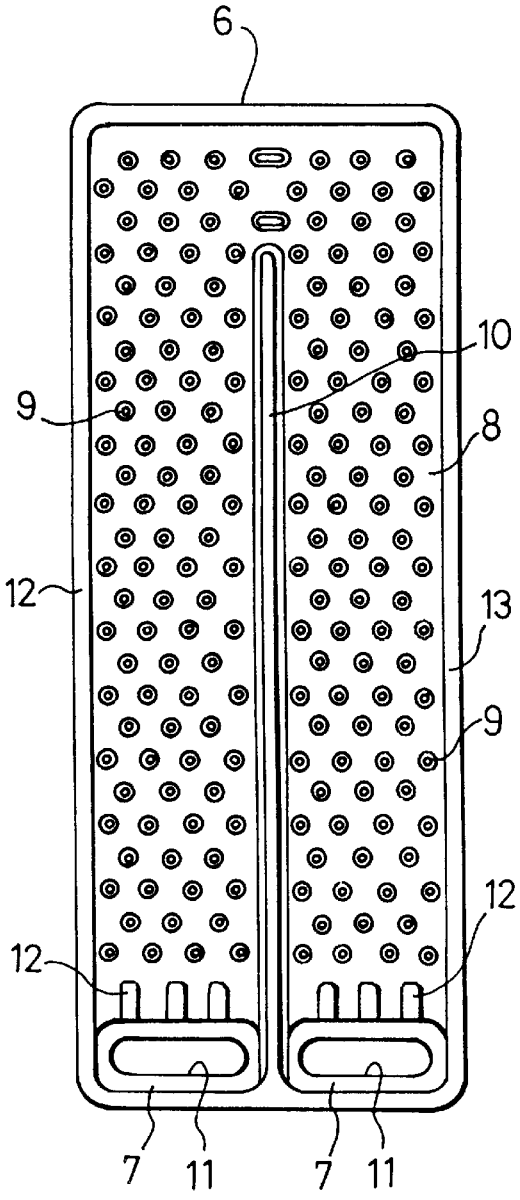
FIGS. 2A and 2B illustrate formed plates constituting tube elements of the laminated heat exchanger shown in FIG. 1.

The tube elements 3*a* and 3*b* at the two ends in the direction of the lamination are each constituted by bonding a roughly flat plate (flat plate) 16 to the outer side of the formed plate 6 shown in FIG. 2A. In addition, the tube element 3*e* is constituted by combining a regular formed plate 6 with a formed plate 6*a* (shown only in FIG. 1) which is not provided with a communicating hole in the distended portion for tank formation at one side, and this non-communicating portion constitutes a partitioning portion 17 that partitions one of the tank groups in the middle thereof. Alternatively, the partitioning portion 17 may be constructed by providing a thin plate between the tube elements to block off the communicating hole instead of forming a distended portion for tank formation 7 with no communicating hole 11. Since other structural features are identical to those of the regular formed plate 6, their explanation is omitted.

Figure 2B:
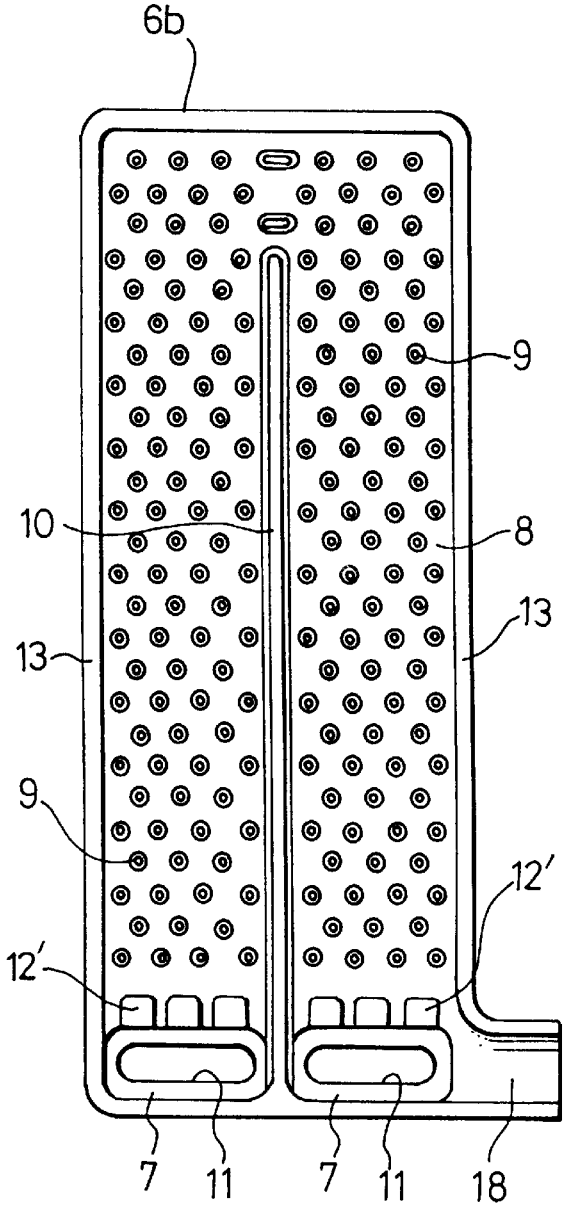

The tube elements 3*c* and 3*d* are formed with intake/outlet portions 4 and 5, respectively. The intake/outlet portions each project out and open from one of the tank portions. Also, tube elements 3*c* and 3*d* are each constituted by bonding face-to-face the formed plate 6*b* shown in FIG. 2B and the formed plate 6*c* (shown only in FIG. 1), which is symmetrical to it. The formed plate 6*b* (or 6*c*) is identical to the formed plates that constitutes other tube elements 6 in that two bowl-like distended portions for tank formation 7 are formed at one end, in that a distended portion for passage formation 8 is formed continuous thereto, in that cylindrical beads 9 and a projection 10 are formed in the distended portion for passage formation 8 as integrated parts thereof with the projection 10 extending from the area between the distended portions for tank formation, in that the distended portions for tank formation 7 are formed so as to distend to a greater degree than the distended portion for passage formation 8 and in that a communicating hole 11 is formed in each distended portion for tank formation. However, the formed plate 6*b* (or 6*c*) differs from the other tube elements 6 in that a curved portion 18 constituting the intake portion 4 or the outlet portion 5 is provided and extends from one of the distended portions for tank formation 7 and in that the shape of the shoal-like beads 12' is different from those in the tube elements 6.

Figure 3:
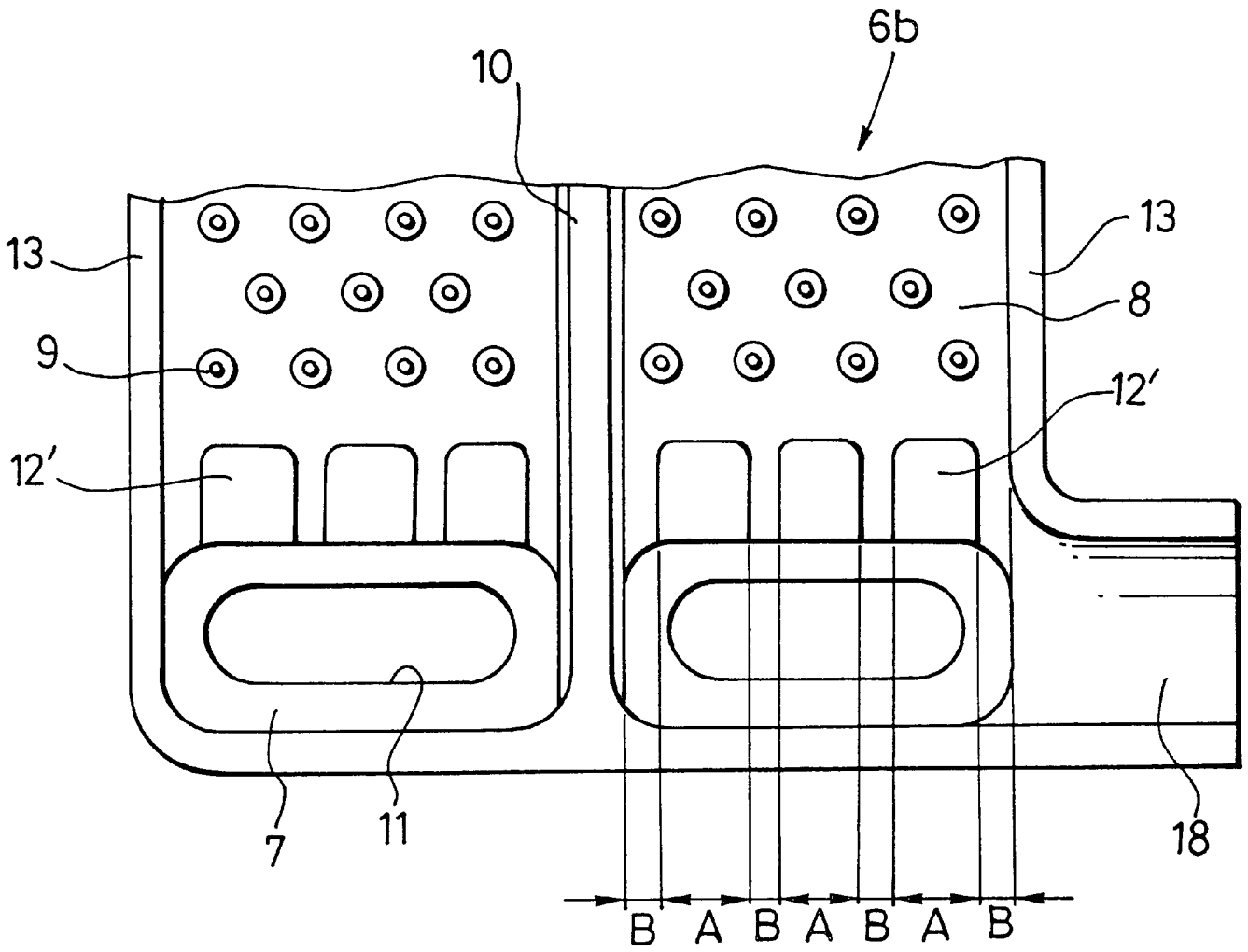
FIG. 3 is a partial enlargement of FIG. 2B; illustrating areas where the distended portions for tank formation change to the distended portion for passage formation.

The shoal-like beads 12' in each of the formed plates constituting the tube elements 3*c* and 3*d* are formed in the areas where the distended portions for tank formation 7 change to the distended portion for passage formation 8 over equal intervals B having a specific bead width A, as shown in FIG. 3. And, the distance between the bonding margin 13 and the shoal-like beads 12' and the distance between the projection 10 and the shoal-like beads 12' are each set to the distance B, as well. Since the coolant is caused to flow through the channels at the two sides of each of the three shoal-like beads 12' in this embodiment, four flow paths are formed in each of the areas where the tank portions change to the U-turn passage portion.

The distance between the formed plates at the U-turn passage portion 15 is set at the same distance for all the tube elements. In addition, the total flow passage areas where the tank portions 14 change to the U-turn passage portions 15 in the tube elements 3*c* and 3*d* is set smaller than the total flow passage area in the other tube elements 3. In other words, the shoal-like beads 12' in the tube elements 3*c* and 3*d* are formed to have a larger width than the shoal-like beads 12 in the other tube elements 3.

Thus, in the heat exchanger 1, adjacent tube elements are abutted at their tank portions so as to form two tank groups extending in the direction of the lamination (at a right angle to the direction of airflow), as shown in FIG. 1. While the individual tank portions in one of the tank groups communicate with each other via the communicating holes 11 formed in the distended portions for tank formation except for at the partitioning portion 17 at the center in the direction of the lamination and all the tank portions in the other tank group communicate with each other via the communicating holes 11 without being partitioned.

Consequently, the one tank group which is partitioned by the partitioning portion 13 is divided into a tank block that communicates with the intake/outlet portion 4 and a tank block that communicates with the intake/outlet portion 5 so that the coolant which flows in through the intake/outlet portion 4 becomes dispersed throughout the entirety of the tank block toward the intake and then travels upward along the projections through the U-turn passage portions 15 of the individual tube elements (first pass). Then, it travels downward after making a U-turn above the projections 10 (second pass) to reach the tank group on the opposite side. After this, it moves horizontally to the remaining tube elements constituting the tank group on the opposite side, and travels upward again along the projections 10 through the U-turn passage portions 15 of the tube elements (third pass). It then travels downward after making a U-turn above the projections 10 (fourth pass) and flows out through the intake/outlet portion 5 after collecting in the tank block toward the outlet.

Figure 4A:
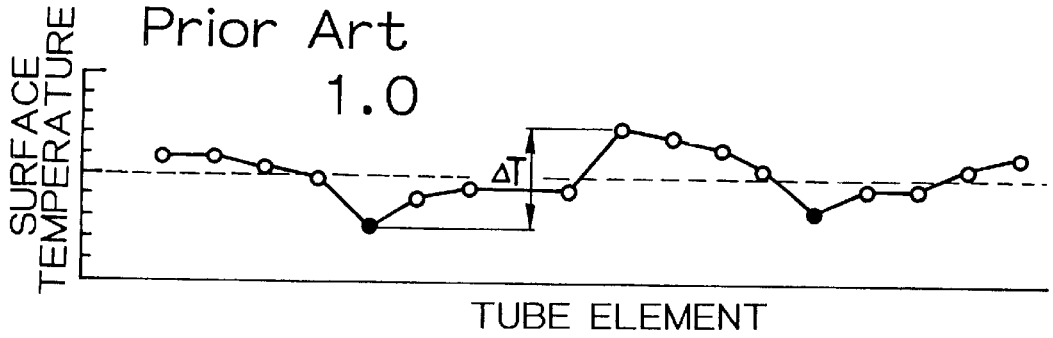
FIG. 4A Prior Art
FIGS. 4A, 4B, 4C, and 4D are graphs indicating the results of measurements of the surface temperatures at the individual tube elements, performed by changing the flow passage area of the tube elements provided with the intake/outlet portions.
Figure 4B:
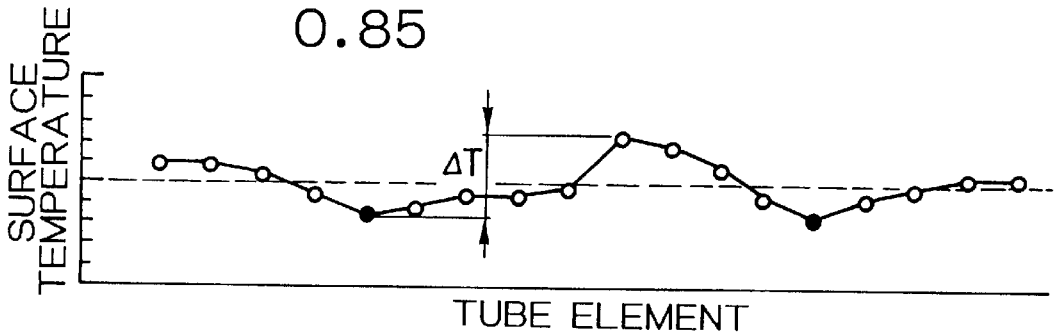
Figure 4C:
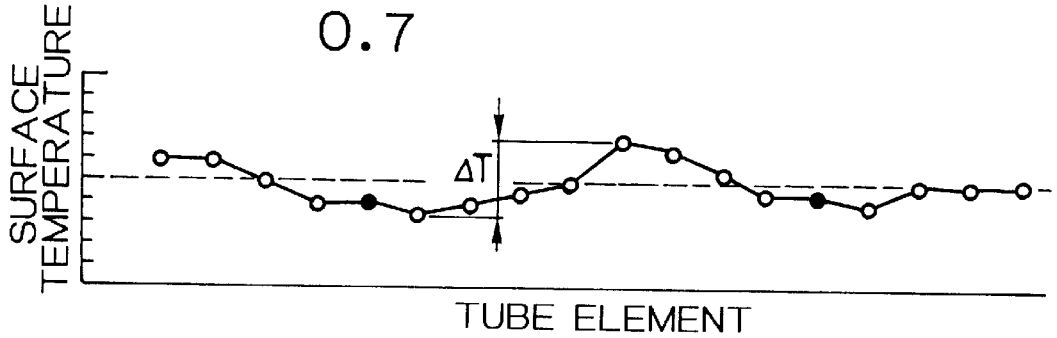
Figure 4D:
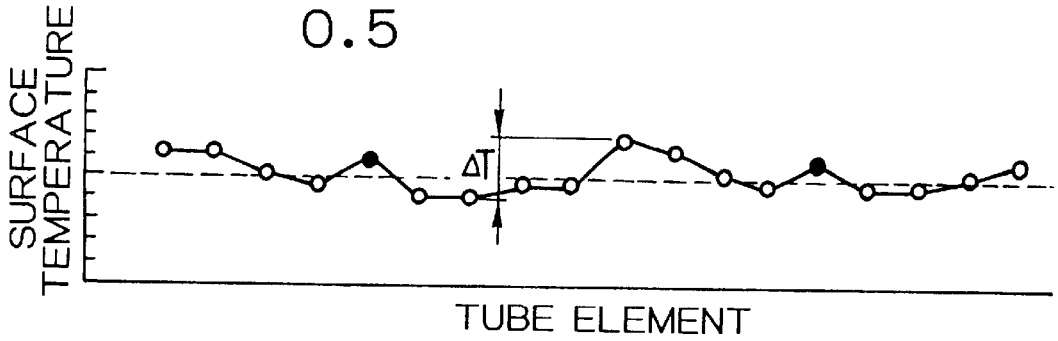

FIGS. 4A through 4D show the results of measurements of the surface temperatures at the individual tube elements performed by causing a coolant at a specific temperature to flow at a specific flow rate while changing the flow passage area in the areas where the tank portions 14 change to the U-turn passage portions 15. The number in the upper left comer of each figure represents the ratio of the flow passage cross section in the areas where the shoal-like beads 12' are formed in the tube elements 3*c* and 3*d* where the intake/outlet portions are formed against that in the other tube elements. FIG. 4A represents a prior art heat exchanger, in which the flow passage cross section is set the same as that in the other tube elements, FIG. 4B representing a structure in which the flow passage cross section ratio is set at 0.85, FIG. 4C represents a structure in which the flow passage cross section ratio is set at 0.7 and FIG. 4D represents a structure in which the flow passage cross section ratio is set at 0.5. In addition, the outline circles plotted on the figures correspond to the surface temperatures of the individual tube elements shown in FIG. 1, and the filled circles indicate the surface temperatures at the tube elements 3*c* and 3*d* where the intake/outlet portions 4 and 5 are formed.

Figure 5A:
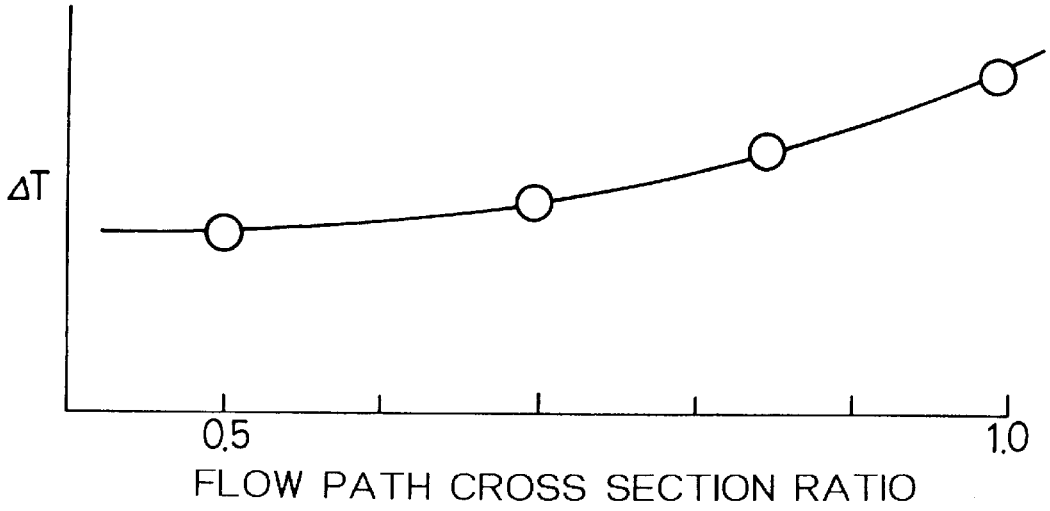
FIG. 5A is a characteristics diagram illustrating changes in the difference (T) between the maximum value and the minimum value of the surface temperature relative to changes in the flow passage area.

As these measurement data clearly indicate, while, in the prior art structure, the surface temperatures at the tube elements 3*c* and 3*d* provided with the intake/outlet portions are lower than those in the other tube elements since the coolant flows into these tube elements in greater quantity, the surface temperatures become relatively higher as the flow passage cross section is constricted to a greater degree, inhibiting a concentrated flow of coolant into these tube elements 3*c* and 3*d* to disperse the coolant to the other tube elements more thoroughly. In addition, as the flow passages of the tube elements 3*c* and 3*d* are constricted to a greater degree, the overall inconsistency in temperature distribution becomes reduced and the surface temperature difference (AT) between the surface temperature at the tube element where the temperature is the highest and the surface temperature at the tube element where the temperature is the lowest is reduced (see FIG. 5A).

Figure 5B:
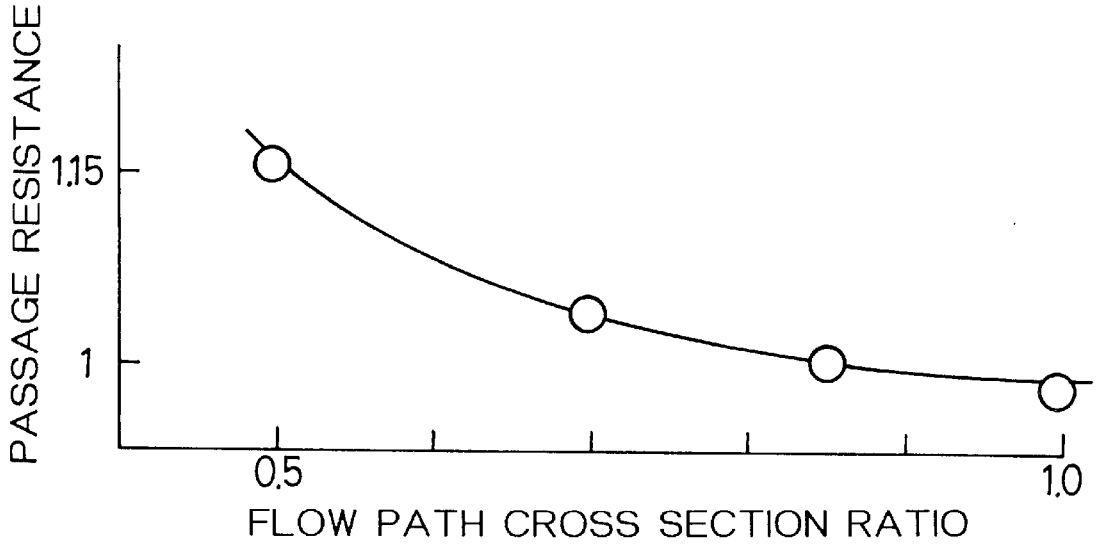
FIG. 5B is a characteristics diagram showing changes in passage resistance relative to changes in the flow passage area.

Thus, as indicated by the data above, the smaller the flow passage cross section in the tube elements 3*c* and 3*d* provided with the intake/outlet portions, the smaller the temperature difference becomes, to improve the temperature distribution. However, as shown in FIG. 5B, as the flow passage cross section is reduced, the passage resistance in the tube elements 3*c* and 3*d* provided with the intake/outlet portions become gradually greater, which will ultimately affect the heat exchanging capability.

At present it is considered most desirable to set the flow passage cross section ratio in the heat exchanger described above at approximately 0.7 by taking into account the balance between reduced passage resistance and reduced flow passage area. Although, since only the tube elements where the intake/outlet portions are provided, i.e., the tube elements 3*c* and 3*d*, have their flow passage cross sections constricted among all the tube elements that are laminated over a plurality of levels (18 levels), the heat exchanging capability of the heat exchanger itself is not greatly affected.

It is to be noted that broad shoal-like beads are formed at both the upstream airflow side and the downstream airflow side in the tube elements 3*c* and 3*d* in this embodiment, the broad-like beads may be formed only at either the upstream side or the downstream side for the purpose of reducing the flow rate of the coolant by reducing the flow passage area and the shoal-like beads at the other side may be formed identically to those in the prior art. In addition, although it is desirable to constrict the flow passage areas at both the outlet side and the intake side, it is also acceptable to constrict the flow passage area only at one side.

Figure 6:
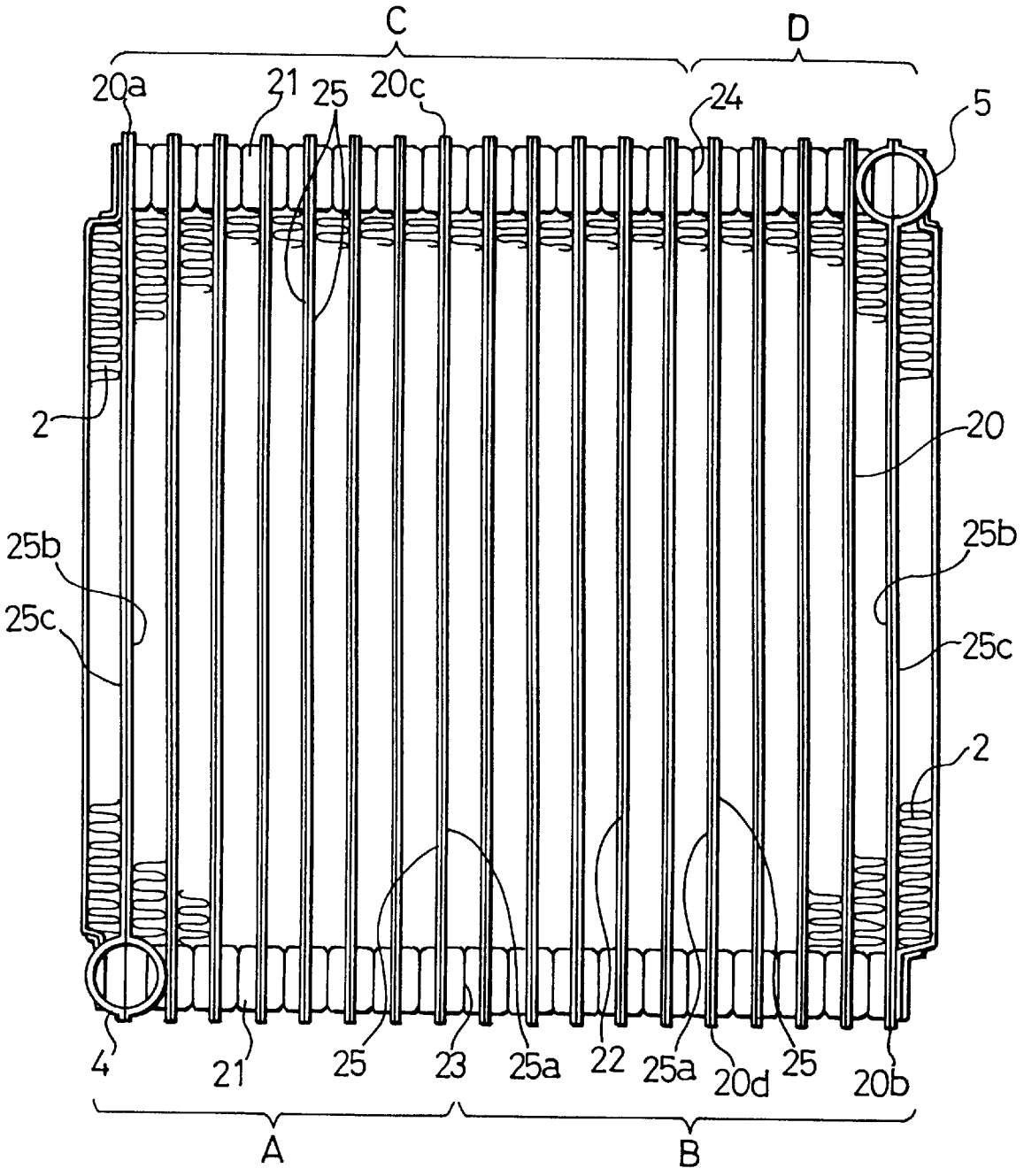
FIG. 6 is a front view of a bilateral tank type laminated heat exchanger according to the present invention.

FIG. 6 shows an example of a bilateral tank type laminated heat exchanger. In this heat exchanger, tank portions 21 are formed at the two ends of each tube element with a heat exchanging medium passage portion 22 communicating between them. In addition, adjacent tube elements are bonded by abutting their tank portions 21, fins 2 are provided between the heat exchanging medium passage portions 22 and intake/outlet portions 4 and 5 are formed at tube elements 20*a* and 20*b* respectively at the two ends of the heat exchanger in the direction of the lamination.

The tank group formed at one end is divided into a first tank block and a second block (A and B) by a partitioning wall 23 at tube element 20*c*, whereas the tank group formed at the other end is divided into a third tank block and a fourth block (C and D) by a partitioning wall 24 at tube element 20*d*. The coolant that has flowed in through the intake portion 4 is dispersed throughout all the tank portions constituting the first tank block A and reaches the third tank block C after traveling upward through the heat exchanging medium passage portions 22 of the tube elements constituting the first tank block A (first pass). Then, it travels horizontally to the remaining tube elements constituting the third tank block C, and travels downward through the heat exchanging medium passage portions 22 of those tube elements to enter the second tank block B (second pass). After this, it travels horizontally to the remaining tube elements constituting the second tank block B and travels upward through the heat exchanging medium passage portions 22 of those tube elements to enter the fourth tank block D (third pass) before it flows out through the outlet portion 5.

The tube elements 20 are each constituted by bonding two symmetrically formed plates 25 face-to-face, and in the tube elements 20*c* and 20*d*, formed plates 25*a*, which are not provided with communicating holes at the positions corresponding to the positions of the partitioning walls 23 and 24, are employed. In addition, the tube elements 20*a* and 20*b* where the intake/outlet portions 4 and 5 respectively are formed are each constituted by bonding the formed plate 25*b* shown in FIG. 7 with a plate 25*c*, which is formed in an almost flat shape except for the end portion where the intake or outlet portion is formed.

Figure 7:
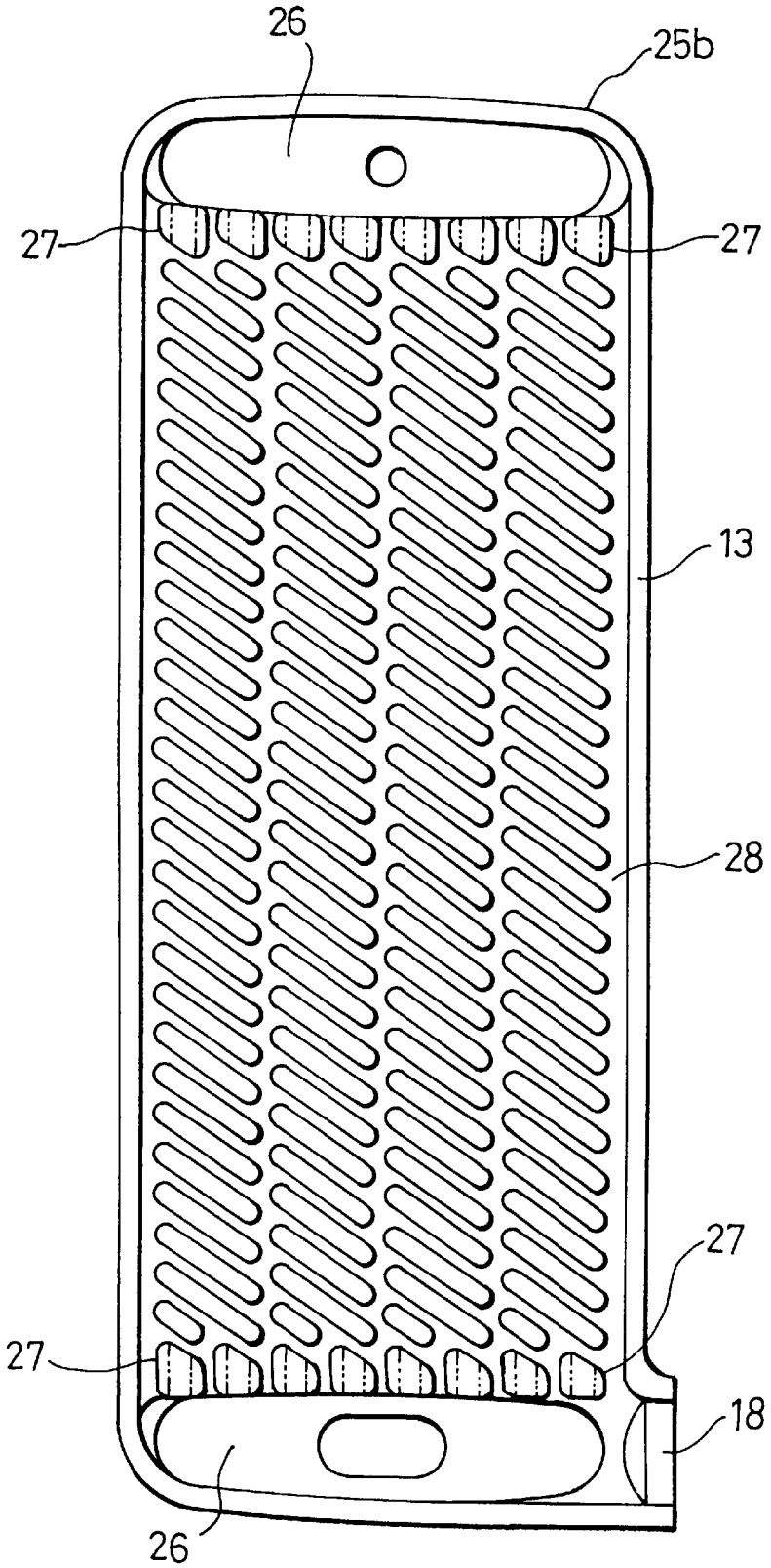
FIG. 7 shows a formed plate constituting the tube elements where the intake/outlet portions are formed in the laminated heat exchanger shown in FIG. 6.

The formed plate 25*b* shown in FIG. 7 is shaped identically to the formed plates used to form the other tube elements except for the curved portion 18' for constituting an intake or outlet portion that is formed at one of its distended portions for tank formation 26 and the shoal-like beads 27, which are shaped differently. In the formed plate 25*b*, the areas where the distended portions for tank formation 26 change to the distended portion for passage formation 28 are formed so as to have approximately the same tube element width in the direction of airflow (the length of its short side), and a plurality (8, for instance) of shoal-like beads 27 are formed in these areas. With this structure, too, the width of the shoal-like beads 27 in the tube elements 20*a* and 20*b* where the intake/outlet portions 4 and 5 are formed is set larger than the bead width in the other tube elements indicated with the broken lines so that the flow of the coolant, which tends to concentrate in these tube elements, is inhibited in order to improve the temperature distribution.

It is to be noted that while, in the two embodiments explained above, the total flow passage cross section is reduced by increasing the width of the shoal-like beads without reducing the number of flow passages, the total flow passage area may be reduced through a reduction in the number of flow passages which may be achieved by integrating adjacent shoal-like beads, as necessary. Such a structure will be particularly effective in the heat exchanger shown in FIGS. 6 and 7 with a large number of shoal-like beads.

As has been explained, since, according to the present invention, the flow passage cross section in the areas where the tank portions change to the passage portion in each of the tube elements where the intake/outlet portions are formed in the laminated heat exchanger is reduced compared to that in the other tube elements, heat exchanging medium does not concentrate in the tube elements where the intake/outlet portions are formed and, thus, the inconsistency in temperature which varies among the individual tube elements can be reduced by achieving maximum consistency in the flow rate of the coolant flowing in the individual tube elements.

FIGS. 8A through 11B show another embodiment of the laminated heat exchanger according to the present invention. This heat exchanger 101 may be an evaporator or the like installed in a cooling unit with, for instance, four passes, which may be constituted by laminating, for instance, 26 tube elements 102, 103, 104 and 105 alternately with corrugated fins 106 over a plurality of levels to form a core main body with end plates 107 provided at the two sides of the core main body in the direction of the lamination. Also, an intake portion 108 or an outlet portion 109 is provided at one end of two tube elements 2 in the direction of airflow. Liquid coolant or the like is used as the heat exchanging medium.

Figure 8A:
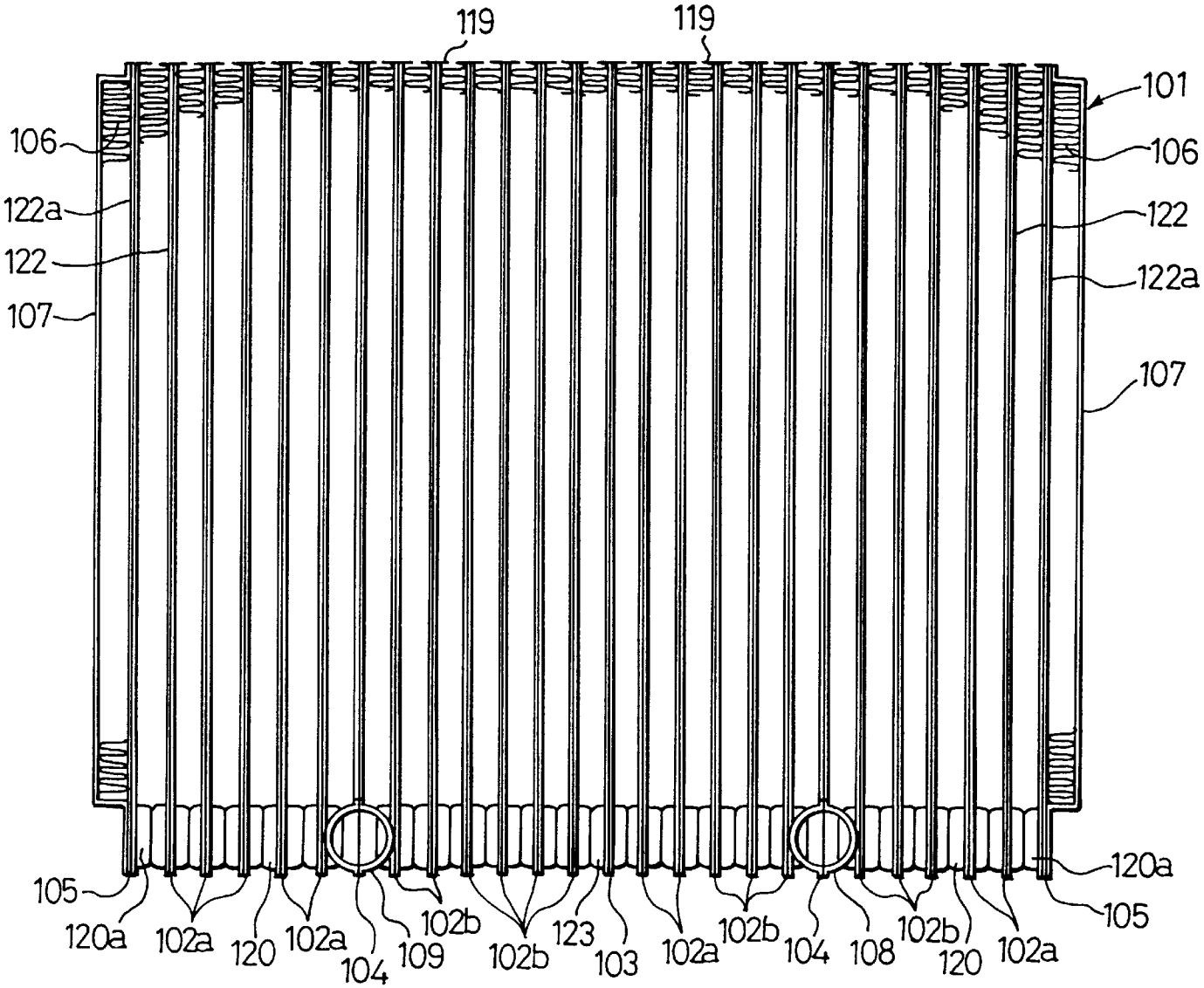
FIG. 8A is a front view of the heat exchanger according to the present invention and FIG. 8B is a bottom view of the same heat exchanger.
Figure 8B:
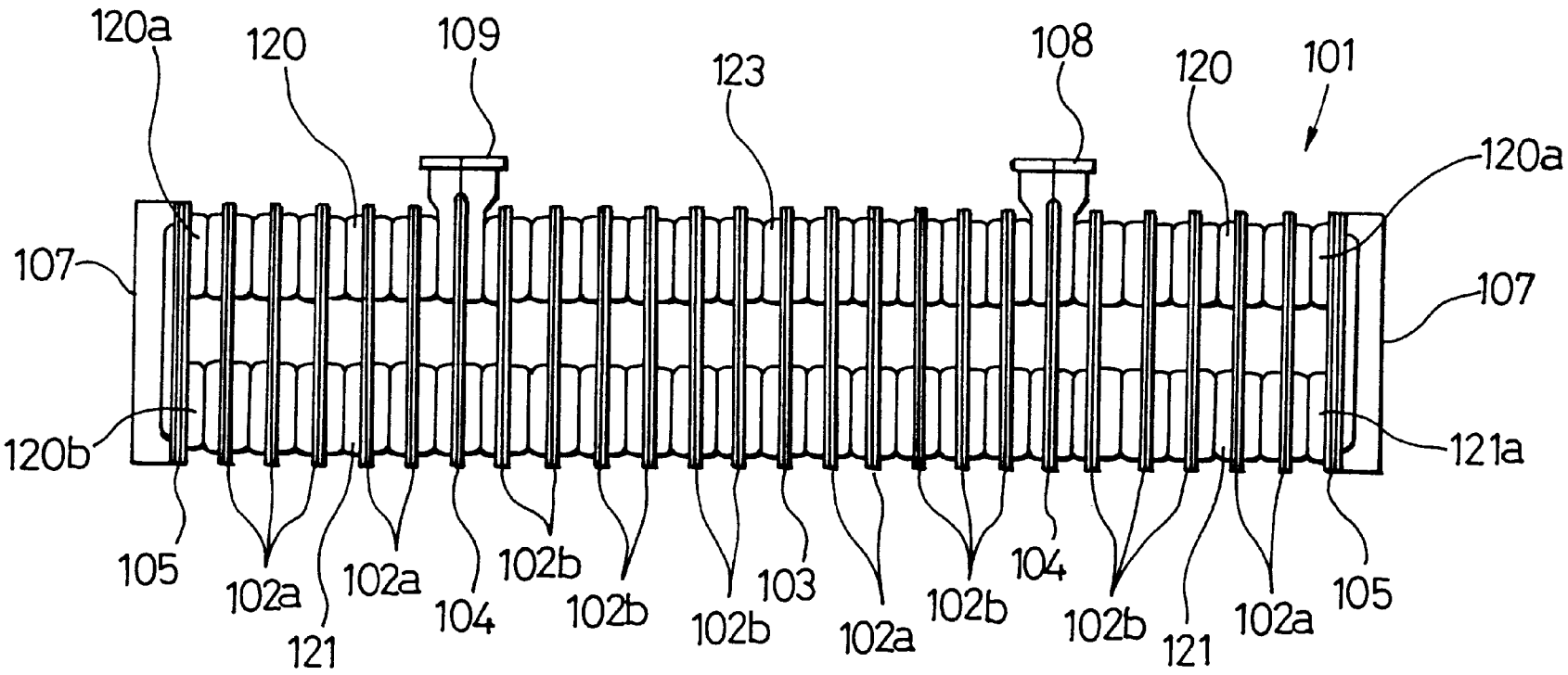
Figure 9A:
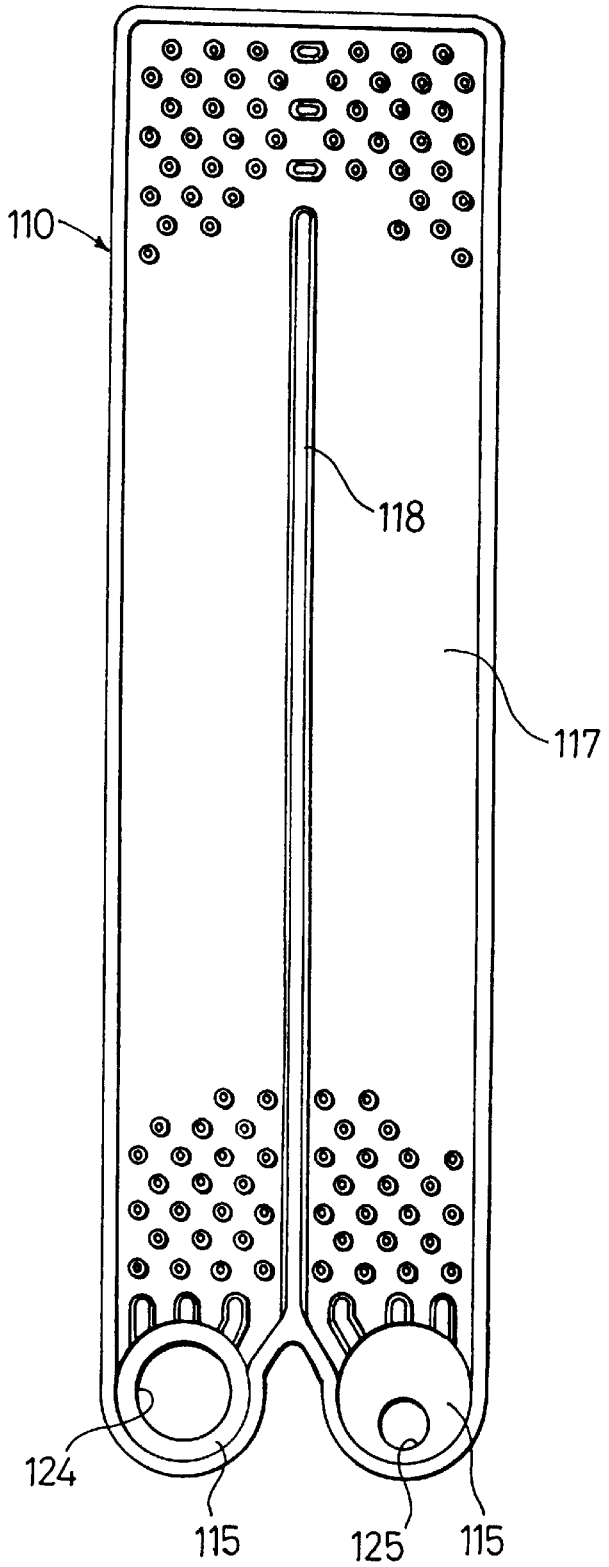
FIG. 9A is a plan view of a formed plate provided with communicating holes formed in a lower portion of the plate, and, which is employed in the heat exchanger in FIG. 8.
Figure 9B:
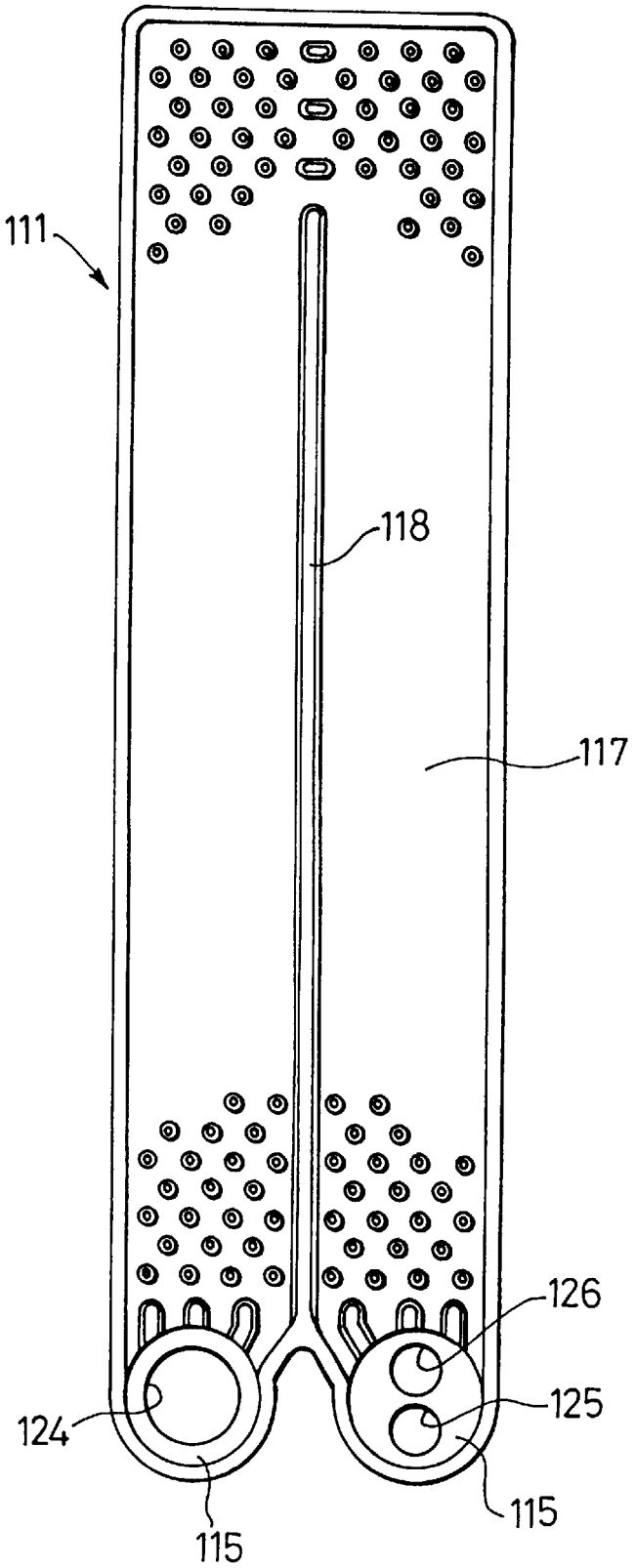
FIG. 9B is a plan view of a formed plate provided with two communicating holes formed side-by-side, which is used in the same heat exchanger

Of those tube elements, the tube elements 102 (102*a*, 102*b*) constitute most of the core main body of the heat exchanger (the second through sixth tube elements and the eighth through twelfth tube elements counting from the right-hand side in the direction of the lamination in FIG. 8, the second through sixth tube elements and the eighth through thirteenth tube elements counting from the left-hand side in the direction of the lamination in FIG. 8), and they are each constituted by bonding two formed plates 110 or 111, shown in FIGS. 9A and 9B.

The formed plate 110 or 111 is formed by press machining an aluminum plate clad with a brazing material, and is provided with two bowl-like distended portions for tank formation 115 at one end having a communicating hole formed in each to be detailed later. It is also provided with a distended portion for passage formation 117 continuous to the distended portions for tank formation. In the distended portion for passage formation 117, a projection 118 is provided extending from the area between the distended portions for tank formation 115 to the vicinity of the other end of the formed plate 110. At the end opposite from the end where the distended portions for tank formation 115 and 115 are formed in the formed plate 110, a projecting piece 119 is provided for preventing the fins 106 from falling out during assembly preceding brazing as specifically shown in FIG. 8A.

The distended portions for tank formation 115 are formed so as to distend to a greater degree than the distended portion for passage formation 117, and the projection 118 is formed to rise to the same plane as the bonding margin at the peripheral edges of the formed plate. When two formed plates 110 or 111 are bonded at their peripheral edges, their projections 118 also become bonded to each other, with a pair of tanks 120 and 121 formed by the distended portions for tank formation 115 which face opposite each other and a U-shaped passage 122 communicating between the tanks 120 and 121 formed by the distended portions for passage formation 117 that face opposite each other.

It is to be noted that the formed plate 110 and the formed plate 111 differ from each other in the way that their communicating holes are formed. Namely, as shown in FIG. 9A, in the formed plate 110, communicating holes 124 and 125 are formed in its distended portions for tank formation 115. Of these, the communicating hole 124 is formed as a circle concentrically with the center of the distended portion for tank formation 115, but the communicating hole 125 has a smaller flow passage area than the communicating hole 124 and is formed in a circular shape having its center at a position further toward the end than the center of the distended portion for tank formation 115. In the formed plate 111, on the other hand, while the communicating hole 124 formed in one of its distended portions for tank formation 115 is identical to the communicating hole 124 formed in the formed plate 110 described above, as shown in FIG. 9B, a circular communicating hole 126 is formed further toward the center of the formed plate 111 in its lengthwise direction than the other communicating hole 125 in addition to the communicating hole 125 in the other distended portion for tank formation 115.

Thus, since the flow passage area for the heat exchanging medium is smaller in the tank portions of the tube element 102*a* constituted by bonding the formed plates 110 compared to that in the tube element 102*b* constituted by bonding the formed plates 111, the tube element 102*a* fulfills a function as a constricting portion which controls the flow rate of the heat exchanging medium flowing from the tank portions in the tube element 102*b*.

Figure 9C:
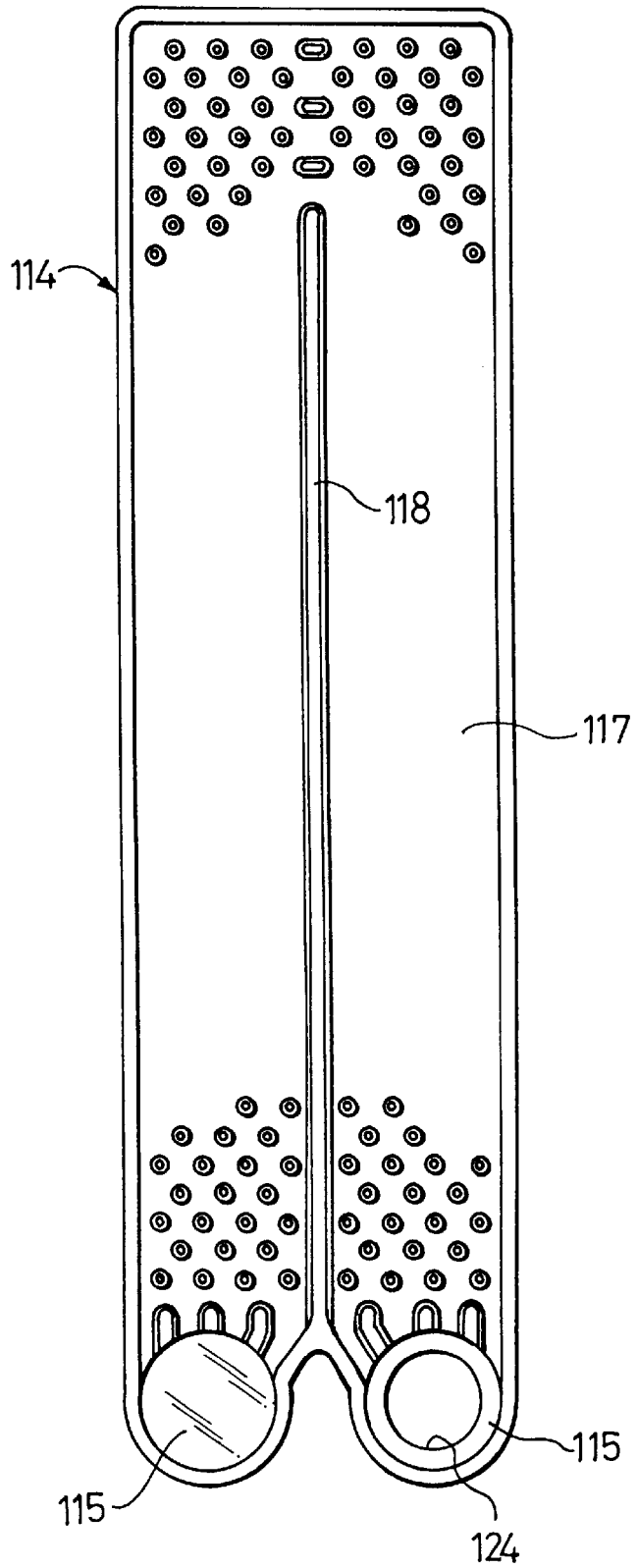
FIG. 9C is a plan view of a formed plate for forming a blind tank, which is used in the same heat exchanger.

The tube element 103 is constituted by bonding the formed plate 110 shown in FIG. 9A and the formed plate 112 shown in FIG. 9C, and is positioned approximately at the center in the direction of the lamination (the thirteenth tube element counting from the right-hand side in the direction of the lamination in FIG. 8). Although the formed plate 112 has structural features basically identical to those in the formed plates 110 and 111 in its distended portions for tank formation 115 and in the distended portion for passage formation 117, it does not have a communicating hole in one of its distended portions for tank formation 115. Thus, when the formed plates 110 and 112 are bonded to each other, a blind tank 123, which is provided with a communicating hole 125 at one side but not provided with a communicating hole at the other side, is formed instead of the tank 120.

The tube elements 104 are each positioned approximately half way between the end plate 107 and the tube element 103 (seventh tube element counting from the right-hand side in the direction of the lamination and the seventh tube element counting from the left-hand side in the direction of the lamination in FIG. 8). In the tube element 104 provided with the intake portion 108, communicating holes 125 and 126 are formed in the tank 120, whereas in the tube element 104 provided with the outlet portion 109, communicating holes 125 and 126 are formed in the tank 121. It is to be noted that, since the formed plates constituting the tube elements 104 have structural features identical to those in the formed plate 110 or 111 except for the fact that they are each provided with a distended portion for intake/outlet portion formation continuous to the distended portion for tank formation 115 for forming the tank 120, their illustration or explanation is omitted.

The tube elements 105, which are positioned at the two sides in the direction of the lamination, are each constituted by bonding the formed plate 110 shown in FIG. 9A and a flat plate (not shown). Thus, the sizes of the tanks 120*a* and 121*a* and the U-shaped passage 122*a* in the tube element 105 are approximately half of those in the other tube elements 102 through 104 explained above, with communicating holes 124 and 125 provided toward the inside in the direction of the lamination.

Consequently, with the heat exchanger 101 constituted by laminating the tube elements 102, 103, 104 and 105 alternately with the fins 106 in such a manner that the tanks 120 and 121 are positioned downward and the bending portions of the U-shaped passages 122 are positioned upward and by providing the end plates 107 at both sides, the adjacent tube elements 102, 103, 104 and 105 are abutted at their tanks 120*a*, 120*a*, 121, 121*a* and 123 to form a tank group α and a tank group β extending in the direction of the lamination at the lower side, with the tank group α further divided into a tank group α1 and a tank group α2 partitioned by the blind tank 123 of the tube element 103 positioned approximately at the center in the direction of the lamination and the tank group beta further divided into a tank group β1 and a tank group β2 which are in communication with each other through the communicating holes 124.

Figure 10:
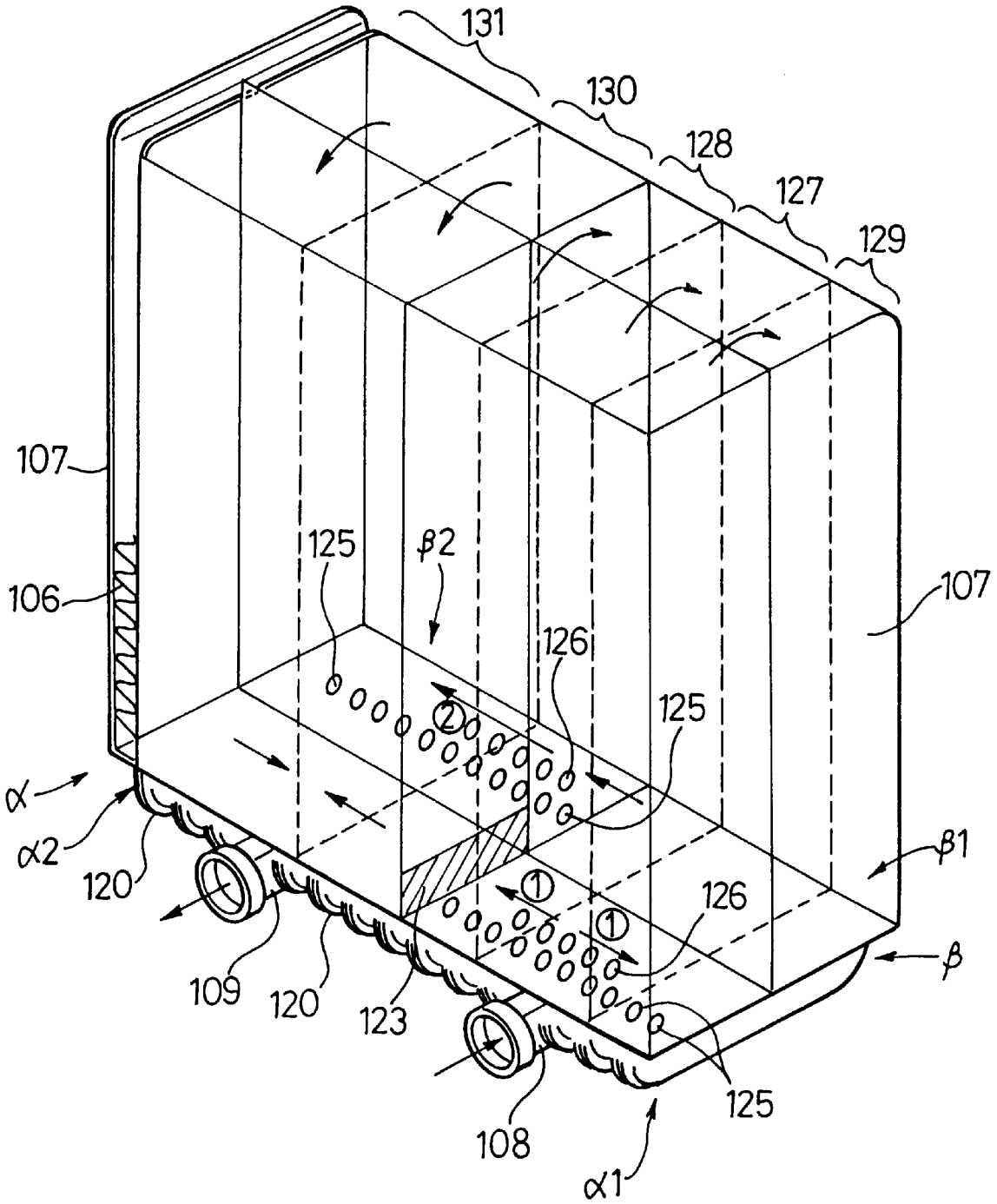
FIG. 10 illustrates the flow of heat exchanging medium in the heat exchanger above, showing blocks in the flow path in the heat exchanger.

Thus, in this heat exchanger 101, too, as shown in FIG. 10, a flow path for the heat exchanging medium similar to that constituted of four passes in a heat exchanger in the prior art is achieved. In other words, the heat exchanging medium that has first flowed into the tank group α1 through the intake portion 108 positioned at the lower side of the heat exchanger 101, then flows through the tank group α1 toward the two sides in the direction of the lamination via the communicating holes of the tanks 120 as indicated by the arrows 1 and also flows into the tank group β1 which faces opposite, by traveling through the U-shaped passages 122. Next, the heat exchanging medium that has flowed into the tank group β1 flows in the direction of the lamination toward the tank group β2 via the communicating holes of the tanks 121 as indicated by the arrow 2, and after this it travels through the U-shaped passages 122 to flow into the tank group α2, to finally flow out through the outlet portion 109.

Now, for the tube elements 102, which are the second through sixth tube elements counting from the right-hand side in the direction of the lamination and also the eighth through twelfth counting from the right-hand side in the direction of the lamination in FIG. 8 to constitute the major portions of the tank groups α1 and β1, tube elements 102*b* are used to constitute the three tube elements next to the tube element 104 at either side and at the two sides of the tube elements 102*b*, tube elements 102*a* are employed. With this, the heat exchanger 101 is divided into a block 127 with a large flow passage area and blocks 128 and 129 located at the two sides of the block 127 with a small flow passage area in the tank group α1 in the direction of the lamination (indicated by the arrows ① in FIG. 10).

In addition, for the tube elements 102, which are the second through sixth tube elements and the eighth through twelfth tube elements counting from the left-hand side in the direction of the lamination in FIG. 8 to constitute major portions of the tank groups α2 and β2, tube elements 102*b* are employed to constitute those up to the sixth tube element counting from the tube element 103 in FIG. 8 toward the left and tube elements 102*a* are employed to constitute the second through sixth tube elements counting from the left-hand side in the direction of the lamination in FIG. 8. Thus, the heat exchanger 101 is divided into a block 130 with a large flow passage area and a block 131 with a small flow passage area in the tank group beta 1 in the direction of the lamination (indicated by the arrow ② in FIG. 10).

Figure 11A:
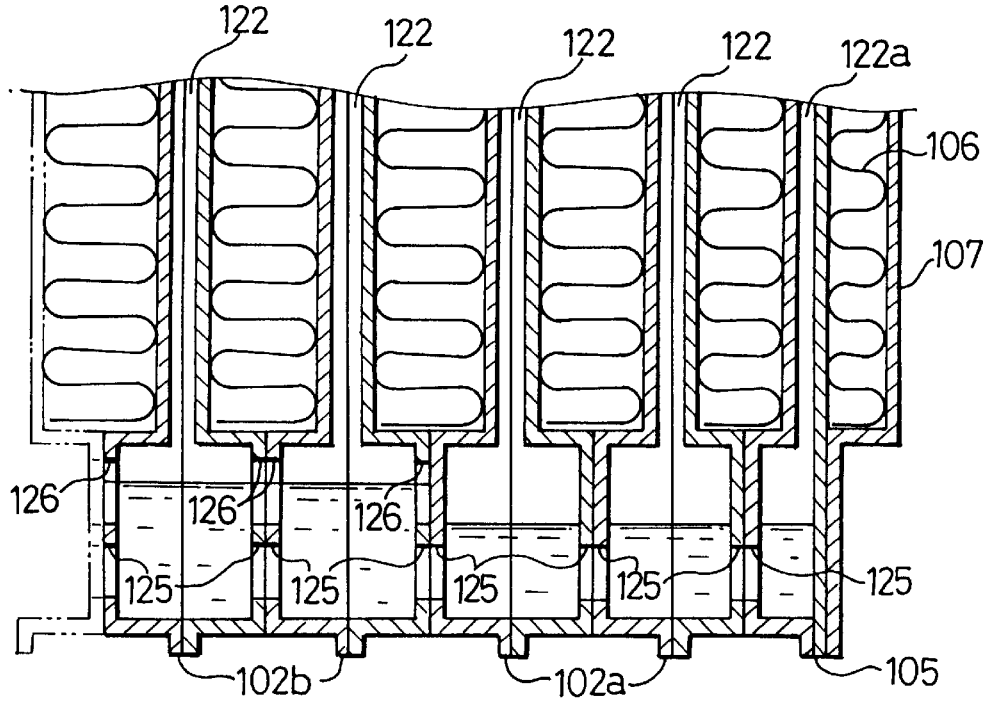
FIG. 11A is a cross section illustrating the flow rate of the heat exchanging medium in the tanks when the heat exchanging medium flows inside the heat exchanger in great quantity and FIG. 11B is a cross section illustrating the flow rate of the heat exchanging medium in the tanks when the heat exchanging medium flows inside the heat exchanger in small quantity.

Consequently, as shown in FIG. 11A, when the flow rate of the heat exchanging medium is high, the heat exchanging medium that has flowed in through the intake portion 108 will flow inside the tank group α1 belonging to the block 127 in great quantity since the flow passage area in the direction of the lamination is large. However, when it flows from the tank group α1 belonging to the block 127 to the tank group α1 belonging to the blocks 128 and 129 or when it flows inside the tank group α1 belonging to the blocks 128 and 129, since the flow passage area in the direction of the lamination is small, it is possible to prevent a great quantity of heat exchanging medium from flowing directly into the tank group α1 belonging to the blocks 128 and 129 due to the force of inertia without thoroughly flowing into the U-shaped passages 122 belonging to the block 127, thereby achieving consistency in the distribution of heat exchanging medium between the block 127 and the blocks 128 and 129. Likewise, when the heat exchanging medium that has flowed in from the tank group β1 flows inside the tank group β2 belonging to the tank block 130, it will flow in great quantity since the flow passage area is large. However, when it flows through the tank group β2 belonging to the block 131, it is prevented from flowing directly into the tank group β2 belonging to the block 131 due to the inertia without thoroughly flowing into the U-shaped passages 122 belonging to the block 130 since the flow passage area is small, thereby achieving near consistency in the distribution of the heat exchanging medium between block 130 and block 131.

Figure 11B:
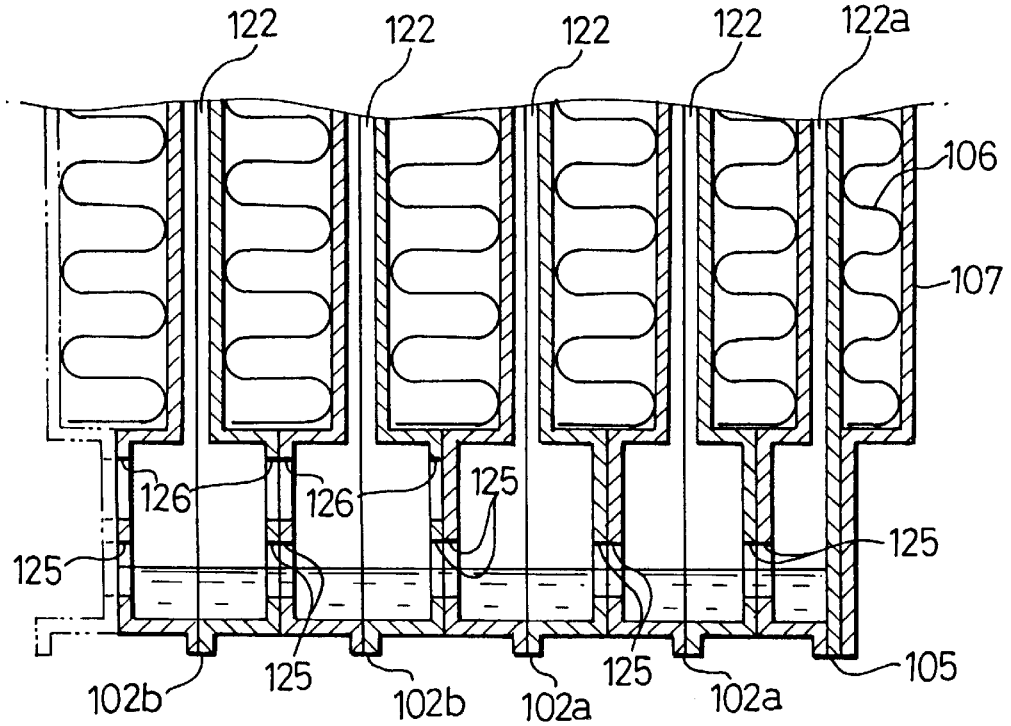

In addition, as shown in FIG. 11B, since, when the flow rate of the heat exchanging medium is low, the heat exchanging medium that has flowed in through the intake portion 108 can flow through the communicating holes 125 positioned downward while it flows within the tank group alpha 1 belonging to the block 128 and while it flows to the tank group α1 belonging to the blocks 128 and 129 from the tank group α1 belonging to the block 127, the heat exchanging medium will be thoroughly distributed to the tank group α1 belonging to the blocks 128 and 129 thereby preventing a shortage of heat exchanging medium in the blocks 128 and 129. Likewise, when the heat exchanging medium flows in the tank group beta 2 belonging to the block 131 and also when it flows from the tank group β2 belonging to the block 130 to the tank group β2 belonging to the block 131, it can flow through the communicating holes 125 positioned downward so that the heat exchanging medium will be thoroughly distributed to the tank group β2 belonging to the block 131, thereby preventing a shortage of heat exchanging medium in the block 131.

It is to be noted that while in reference to the structure of the heat exchanger 101, the tube elements 104 provided with the intake/outlet portions 108 and 109 are the seventh tube elements counting from the right-hand side in the direction of the lamination and the seventh tube element counting from the left-hand side in the direction of the lamination in FIG. 8 as has been explained, the structure of the heat exchanger 101 is not necessarily limited to this arrangement as long as the tanks 120 and 121 are positioned downward.

Figure 12:
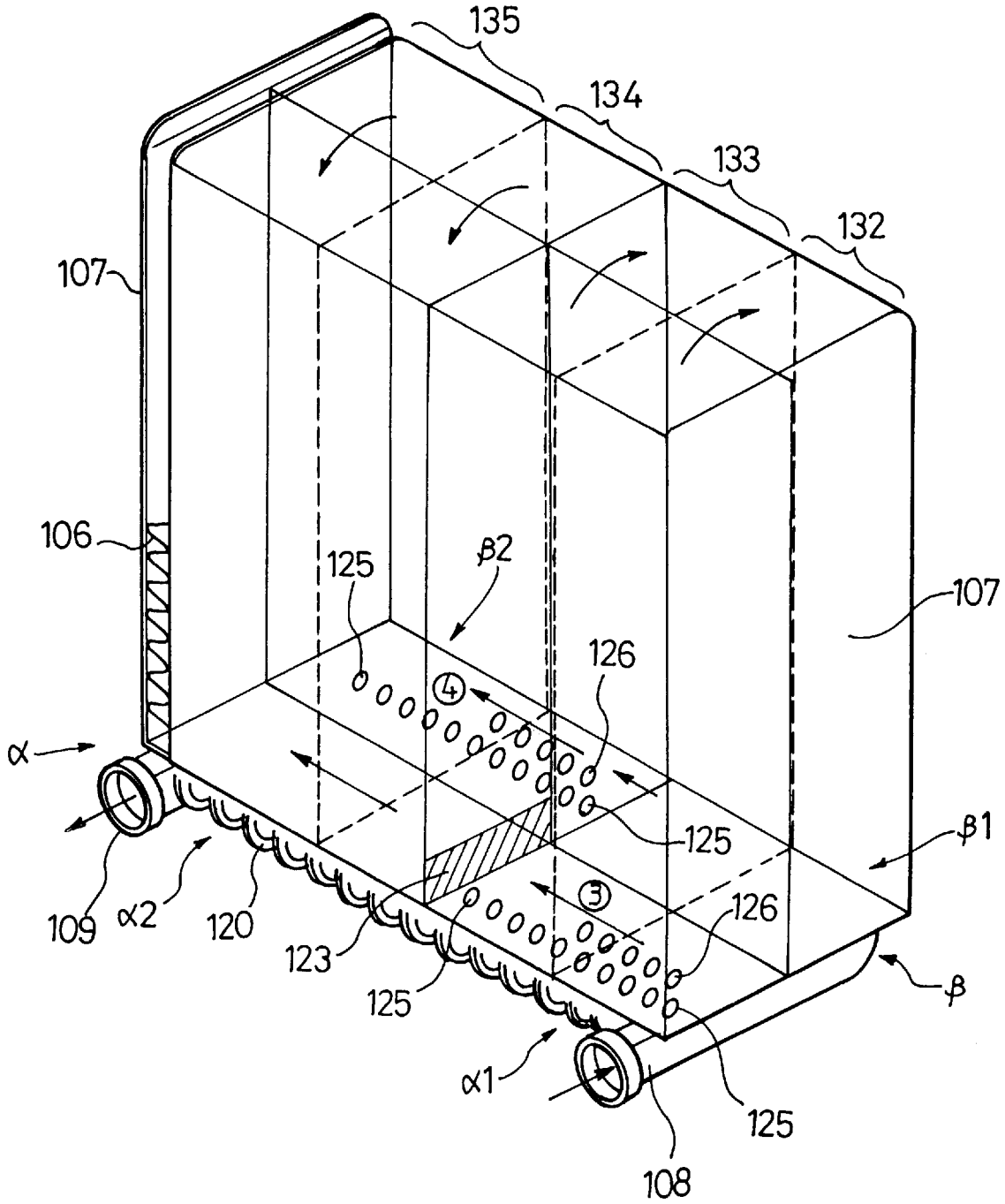
FIG. 12 illustrates the flow and the like of the heat exchanging medium in the heat exchanger in which the intake/outlet portions are located at the two sides in the direction of the lamination.

The tube elements 104 provided with the intake/outlet portions 108 and 109 may also be positioned at the two sides in the direction of the lamination in the heat exchanger 101 as shown in FIG. 12. However, the heat exchanger 101 which is structured in such a manner will have tube elements 102*b* in the area that belongs to the block 132 to increase the flow passage area for the heat exchanging medium, and will have tube elements 102*a* in the area belonging to the block 133 to reduce the flow passage area for the heat exchanging medium, to achieve consistency in distribution of heat exchanging medium entering the tank group a from the intake portion 108 and flowing in the direction of the lamination (arrow ③). It is to be noted that, since the positions of the tube elements 102*a* and 102*b* in the blocks 134 and 135, which achieve consistency in the distribution of heat exchanging medium flowing from the tank group β1 to the tank group β2 in the direction of the lamination (arrow ④) are basically the same as the positioning of the tube elements 102*a* and 102*b* in the blocks 130 and 131 explained earlier, explanation of their positioning is omitted.

Figure 13:
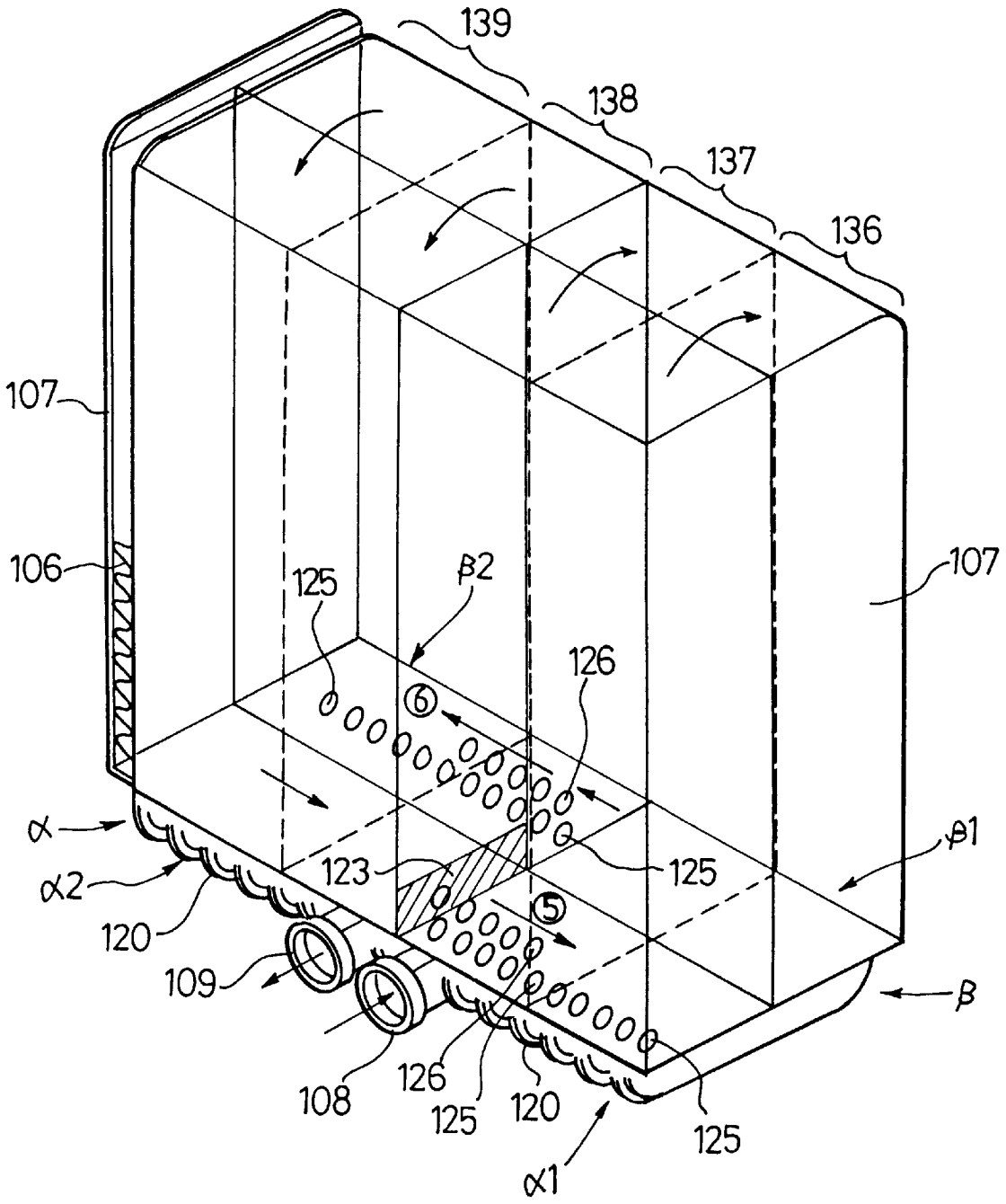
FIG. 13 illustrates the flow and the like of the heat exchanging medium in the heat exchanger in which the intake/outlet portions are located approximately at the center in the direction of the lamination.

Moreover, as shown in FIG. 13, the tube elements 104 provided with the intake/outlet portions 108 and 109 may be positioned at the two sides of the tube element 103 provided with the blind tank 123. However, in the heat exchanger 101 structured in this manner, tube elements 102*a* are provided in the area belonging to the block 136 to reduce the flow passage area of the heat exchanging medium and tube elements 102*b* are provided at a position belonging to the block 137 to increase the flow passage area of the heat exchanging medium so that consistency in the distribution of the heat exchanging medium having flowed into the tank group alpha through the intake portion 108 and flowing in the direction of the lamination (arrow ⑤) is achieved. It is to be noted that since the positions of the tube elements 102*a* and 102*b* in the blocks 138 and 139 for achieving consistency in the distribution of the heat exchanging medium flowing from the tank group beta 1 to the tank group beta 2 in the direction of the lamination (arrow ⑤) are basically the same as those of the tube elements 102*a* and 102*b* in the blocks 130, 131, 134 and 135 explained earlier, their explanation is omitted.

Moreover, while in the explanation given so far, in either the tank 120 or 121 in each tube element 102*a*, the circular communicating hole 125 is provided downward and that in either the tank 120 or 121 in each tube element 102*b* the circular communicating hole 125 and the circular communicating hole 126 are provided side-by-side in the lengthwise direction of the tube element 102*b*, these structural features are only given by way of explanation and the present invention may take another structure as long as the tanks 120 and 121 are formed downward.

Figure 14A:
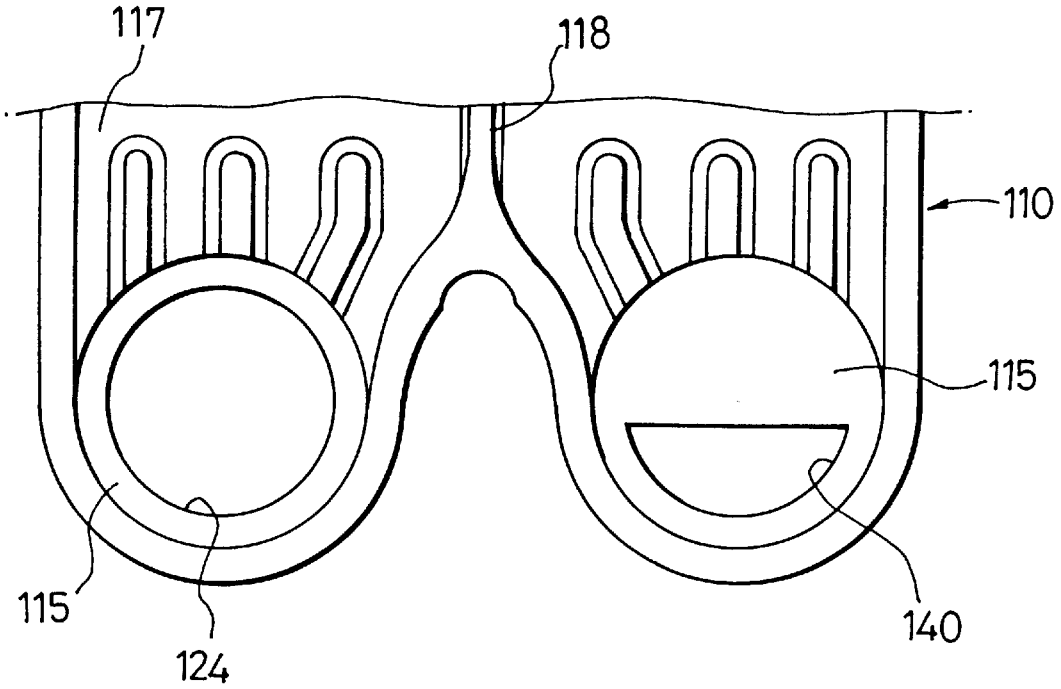
FIGS. 14A and 14B are enlargements of essential portions of formed plates provided with semicircular communicating holes.
Figure 14B:
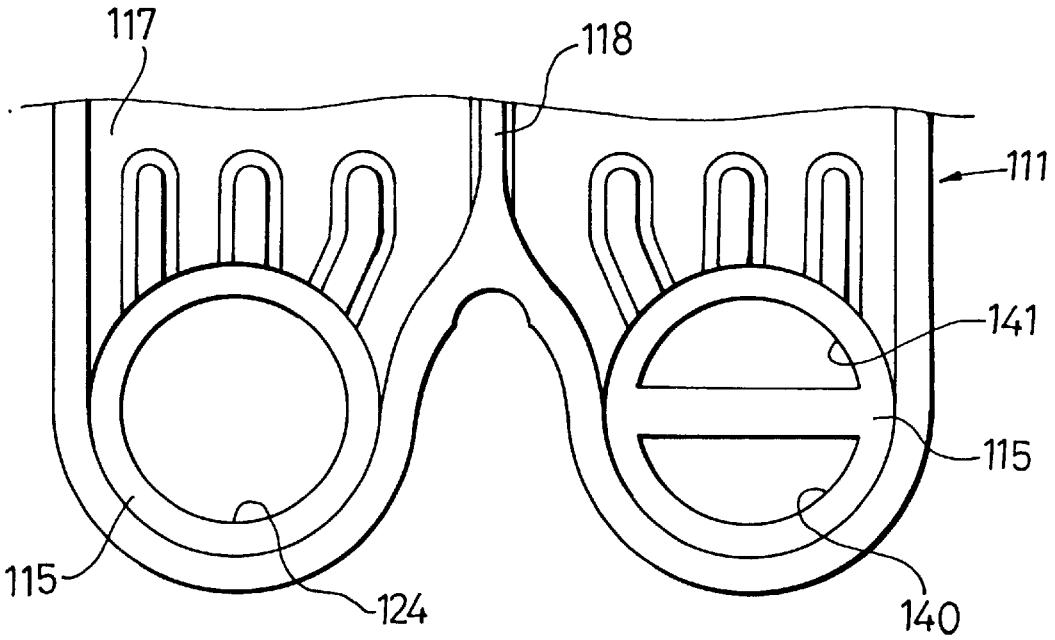

As shown in FIG. 14, the communicating hole in either the tank 120 or 121 in the tube element 102*a* may be formed as a semicircular communicating hole 140 constituted of the lower half of a circle at a downward position and the communicating holes in the tank 120 or 121 in the tube element 102*b* may be constituted with a semicircular communicating hole 141 constituted of the upper half of a circle as well as the communicating hole 140, provided side-by-side in the lengthwise direction of the tube element.

Figure 15A:
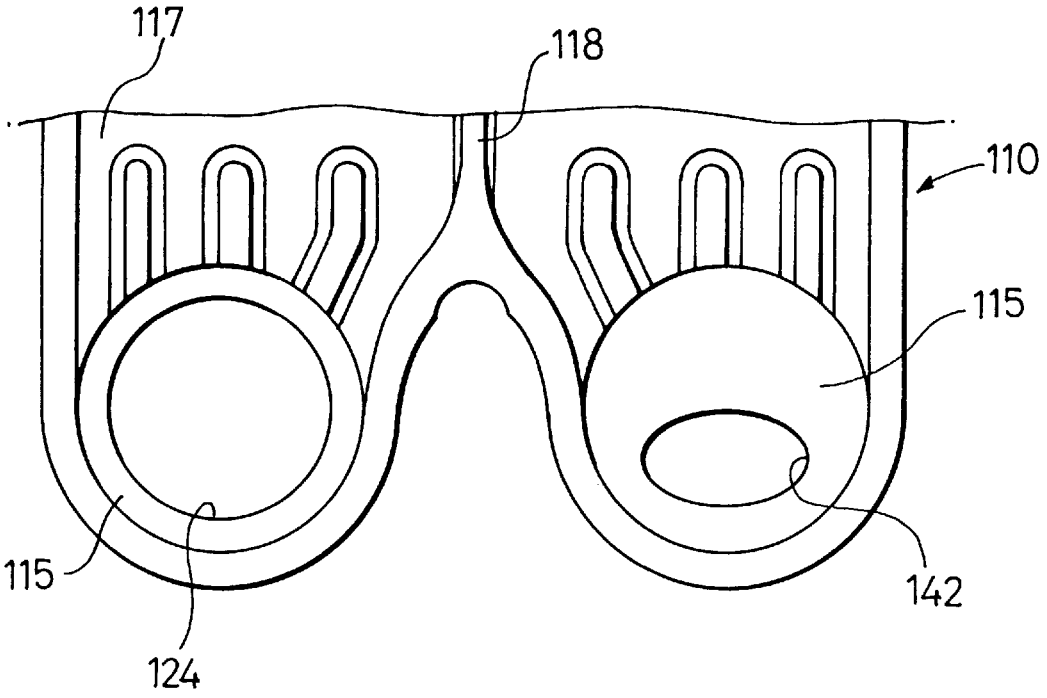
FIGS. 15A and 15B are enlargements of the essential portions of formed plates provided with laterally oriented, oval-shaped communicating holes.
Figure 15B:
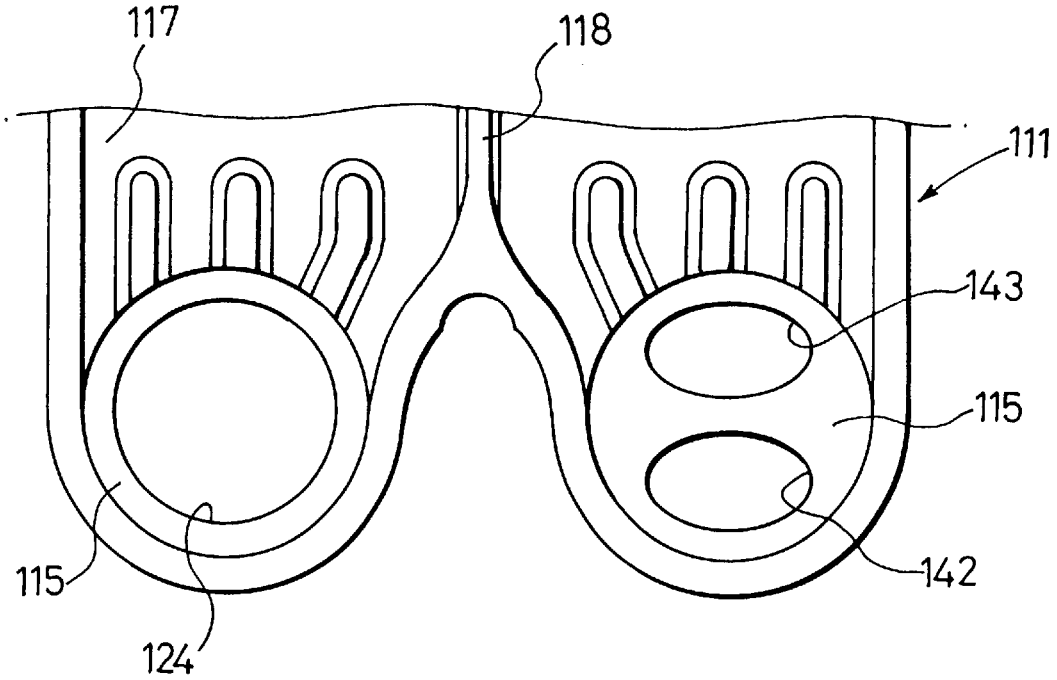

Moreover, as shown in FIG. 15, the communicating hole in the tank 120 or 121 in the tube element 102*a* may be formed as a laterally oriented oval-shaped communicating hole 142 at a downward position and the communicating holes in the tank 120 or 121 in the tube element 102*b* may be constituted with a laterally oriented oval-shaped communicating hole 143 as well as the communicating hole 142 provided side-by-side in the lengthwise direction of the tube element.

Thus, since the flow passage areas in the communicating holes 140 and 142 are smaller than that in the communicating hole 124, they fulfill a function as a constricting portion, and since they are formed downward, even when the flow rate of the heat exchanging medium is low, the heat exchanging medium can flow smoothly by traveling through these communicating holes 140 and 142.

Figure 16:
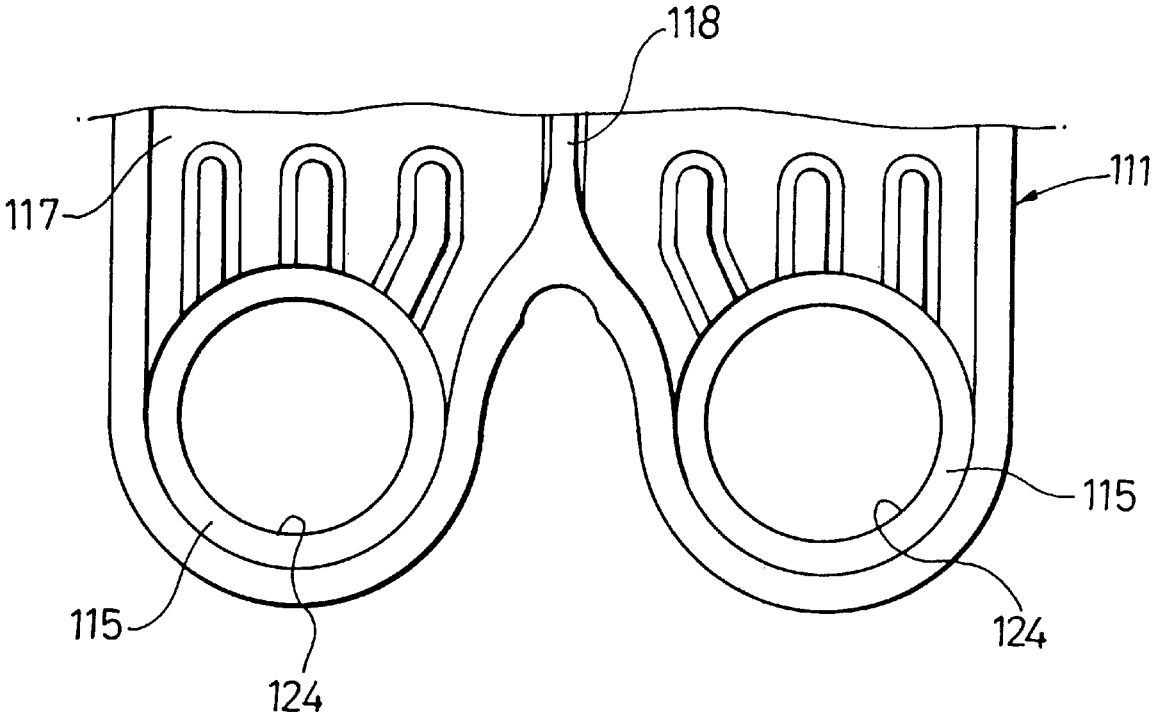
FIG. 16 is an enlargement of the essential portion of a formed plate in which the diameter of the holes is increased instead of increasing the number of holes.

Furthermore, while using tube elements each provided with the communicating hole 124 in one of the tanks 120 and 121 and the communicating hole 125, 132 or 134 formed in the other tank to constitute the tube elements 102*a*, tube elements 102*c*, each provided with the communicating hole 124 in both of the tanks 120 and 121, as shown in FIG. 16, may be employed in place of the tube elements 102*b*. In this case, too, the heat exchanging medium will flow in great quantity in the tank group α1 belonging to the block 127 and the tank group β2 belonging to the block 130 shown in FIG. 10, in the tank group α1 belonging to the block 136 and the tank group β2 belonging to the block 134 shown in FIG. 12 or in the tank group α1 belonging to the block 137 and the tank group β2 belonging to the block 138 shown in FIG. 13.

Lastly, while the present invention has been explained in an application in the 4-pass type heat exchanger 101 provided with the intake/outlet portions 108 and 109 in the direction of airflow, the present invention may be adopted in heat exchangers of other types as well, as long as the tanks are positioned downward, to achieve consistency in the distribution of the heat exchanging medium. In other words, although not shown, the present invention may be adopted in a type of heat exchanger provided with intake/outlet portions at the end plates 107 or in a 6-pass type heat exchanger, in order to achieve consistency in the distribution of the heat exchanging medium when the flow rate of the heat exchanging medium is both high and low, by using the tube elements 102*b* in the vicinity of the inflow position of the heat exchanging medium in a specific tank group into which the heat exchanging medium flows from the outside, using the tube elements 102*a* further inward relative to the inflow position, by providing the tube elements 102*b* in the tank group at the rear flow side of two tank groups communicating with each other only through the communicating hole in the vicinity of the other tank group with which the first tank group at the rear flow side communicates and providing the tube elements 102*a* further inward than the other tank group with which the tank group at the rear flow side communicates.

As has been explained, since, when the flow rate of the liquid type heat exchanging medium is high, the flow passage areas of the communicating holes in the tanks further inward relative to the inflow position in the smaller tank group into which the heat exchanging medium flows from the outside or the tanks further inward relative to the inflow position in the smaller tank group into which the heat exchanging medium flows via the communicating holes from a smaller tank group to which it lies adjacent in the direction of the lamination, are set smaller than the flow passage area of the communicating holes in the other tanks, the flow of the heat exchanging medium is controlled so that the heat exchanging medium is prevented from directly flowing into the tanks further inward in great quantity due to inertia Thus, it is possible to deliver the heat exchanging medium in sufficient quantity to the U-shaped passages communicating with the tanks further toward the front relative to the intake position, the distribution of the heat exchanging medium becomes more consistent, thereby achieving consistency in the temperature distribution of the passing air as well, to ultimately achieve an improvement in the performance of the heat exchanger.

Moreover, when the flow rate of the liquid type heat exchanging medium is low, too, since the communicating holes in the tanks further inward relative to the inflow position in the smaller tank group into which the heat exchanging medium flows from the outside or in the tanks further inward relative to the inflow position in the smaller tank group into which the heat exchanging medium flows via the communicating holes from the smaller tank group to which it lies adjacent in the direction of the lamination are formed at positions further downward than the communicating holes of the other tanks constituting the smaller tank groups, the heat exchanging medium that is flowing in a small quantity on the lower side of the tanks can be guided to the tanks further inward through those communicating holes. Thus, the distribution of the heat exchanging medium becomes more consistent, thereby achieving consistency in the temperature distribution of the passing air and improving the performance of the heat exchanger.

What is claimed is:

1. A laminated heat exchanger comprising:

a plurality of tube elements; and a plurality of fins alternately laminated to surfaces of said tube elements which are disposed adjacent to each other such that said tube elements are aligned along a lamination direction, each of said tube elements including a pair of tanks formed at one end with respect to a longitudinal direction thereof, a first half passage extending from one of said pair of tanks, a second half passage extending from the other of said pair of tanks, said first and second passages defining a U-shaped passage fluidly communicating between said tanks, and communicating holes formed in opposing walls of each of said tanks in the lamination direction of said tube elements, wherein:

a first tank group is defined by said tanks connected along the lamination direction on one side of said tube elements, and said first tank group is partitioned so as to define at least a first tank subgroup and a second tank subgroup located downstream of said first tank subgroup relative to the direction of fluid flow through said laminated tube elements;

a second tank group is defined by said tanks connected along the lamination direction on an opposite side of said tube elements relative to said tanks forming said first tank group;

an odd fluid pass is defined by said tanks defining said first tank subgroup and the first half passages extending from said tanks defining said first tank subgroup;

an even fluid pass is defined by a first plurality of tanks of said second tank group, which are oppositely disposed relative to the tanks of said first tank subgroup, and the second half passages which extend from said first plurality of tanks of said second tank group;

a coolant intake structure is connected to said first tank subgroup;

a coolant outlet structure is connected to a downstream-most one of said tanks of said first and second tank groups;

the communicating openings in a first set of the tanks of said first tank subgroup define flow opening areas which are smaller than opening areas defined by the communicating openings of a second set of tanks of said first tank subgroup;

said first set of tanks are located further from said coolant intake structure than said second set of tanks; and a center of the opening areas of each of said first set of tanks is positioned lower than a center of the opening areas of each of said second set of tanks.

2. A laminated heat exchanger as claimed in claim 1, wherein:

each of said second set of tanks is provided with a plurality of communicating openings in each wall in order to enlarge the opening area thereof relative to the opening areas of said first set of tanks; and each of said first set of tanks has a smaller number of communicating openings in each wall thereof in relation to the number of communicating openings in each wall of said second set of tanks so as to reduce the opening areas of said first set of tanks relative to the opening areas of said second set of tanks.

3. A laminated heat exchanger as claimed in claim 2, wherein:

each of said second set of tanks is provided with two communicating openings in each wall thereof, with one of said communicating openings disposed above the other of said communicating openings; and each of said first set of tanks has a single opening formed in a lower portion of at least one wall thereof.

4. A laminated heat exchanger as claimed in claim 3, wherein:

each of said upper communicating openings of said second set of tanks has an approximately semicircular shape with a chord at a lower portion thereof; and each of said communicating openings formed at said lower portions of said first and second sets of tanks has an approximately semicircular shape with a chord at an upper portion thereof.

5. A laminated heat exchanger as claimed in claim 3, wherein each of said communicating openings of said first set of tanks has an oval shape.

6. A laminated heat exchanger as claimed in claim 1, wherein:

each of the opposing walls of said second set of tanks has a circular shape and is provided with a specific opening area having a center point coinciding with a center of said tank wall; and each of the opposing walls of said first set of tanks has a circular shape and is provided with an opening area which is smaller than said specific opening area and has a center point located below a center of said tank wall.

7. A laminated heat exchanger as claimed in claim 1, wherein:

said coolant intake structure is located approximately in the center of said first tank subgroup; and said coolant outlet structure is located approximately in the center of said second tank subgroup.

8. A laminated heat exchanger comprising:

a plurality of tube elements; and a plurality of fins alternately laminated to surfaces of said tube elements which are disposed adjacent to each other such that said tube elements are aligned along a lamination direction, each of said tube elements including a pair of tanks formed at one end with respect to a longitudinal direction thereof, a first half passage extending from one of said pair of tanks, a second half passage extending from the other of said pair of tanks, said first and second passages defining a U-shaped passage fluidly communicating between said tanks, and communicating holes formed in opposing walls of each of said tanks in the lamination direction of said tube elements, wherein:

a first tank group is defined by said tanks connected along the lamination direction on one side of said tube elements, and said first tank group is partitioned with a partition member so as to define at least a first tank subgroup and a second tank subgroup located downstream of said first tank subgroup relative to the direction of fluid flow through said laminated tube elements;

a second tank group is defined by said tanks connected along the lamination direction on an opposite side of said tube elements relative to said tanks forming said first tank group;

an odd fluid pass is defined by said tanks defining said first tank subgroup and the first half passages extending from said tanks defining said first tank subgroup;

an even fluid pass is defined by a first plurality of tanks of said second tank group, which are oppositely disposed relative to the tanks of said first tank subgroup, and the second half passages which extend from said first plurality of tanks of said second tank group;

a coolant intake structure is connected to said first tank subgroup;

a coolant outlet structure is connected to a downstream-most one of said tanks of said first and second tank groups;

each of the communicating openings of a first series of said tanks, adjacent said partition member, in said first tank subgroup has a smaller opening area than the communicating openings of a second series of said tanks in said first tank subgroup;

each of said tanks in said second series of tanks are located further from said partition member than each of said tanks in said first series of tanks; and a center of each opening area in said first series of tanks is located below a center of said first series of tanks.

9. A laminated heat exchanger as claimed in claim 1, wherein:

each of said second series of tanks is provided with a plurality of communicating openings in each wall in order to enlarge the opening area thereof relative to the opening areas of said first series of tanks; and each of said first series of tanks has a smaller number of communicating openings in each wall thereof in relation to the number of communicating openings in each wall of said second series of tanks so as to reduce the opening areas of said first series of tanks relative to the opening areas of said second series of tanks.

10. A laminated heat exchanger as claimed in claim 9, wherein:

each of said second series of tanks is provided with two communicating openings in each wall thereof, with one of said communicating openings disposed above the other of said communicating openings; and each of said first series of tanks has a single opening formed in a lower portion of at least one wall thereof.

11. A laminated heat exchanger as claimed in claim 10, wherein:

each of said upper communicating openings of said second series of tanks has an approximately semicircular shape with a chord at a lower portion thereof; and each of said communicating openings formed at said lower portions of said first series of tanks and said second series of tanks has an approximately semicircular shape with a chord at an upper portion thereof.

12. A laminated heat exchanger as claimed in claim 9, wherein each of said communicating openings of said first series of tanks has an oval shape.

13. A laminated heat exchanger as claimed in claim 8, wherein:

each of the opposing walls of said second series of tanks has a circular shape and is provided with a specific opening area having a center point coinciding with a center of said tank wall; and each of the opposing walls of said first series of tanks has a circular shape and is provided with an opening area which is smaller than said specific opening area and has a center point located below a center of said tank wall.

14. A laminated heat exchanger as claimed in claim 8, wherein:

said coolant intake structure is located approximately in the center of said first tank subgroup; and said coolant outlet structure is located approximately in the center of said second tank subgroup.

15. A laminated heat exchanger comprising:

a plurality of tube elements; and a plurality of fins alternately laminated to surfaces of said tube elements which are disposed adjacent to each other such that said tube elements are aligned along a lamination direction, each of said tube elements including a pair of tanks formed at one end with respect to a longitudinal direction thereof, a first half passage extending from one of said pair of tanks, a second half passage extending from the other of said pair of tanks, said first and second passages defining a U-shaped passage fluidly communicating between said tanks, and communicating holes formed in opposing walls of each of said tanks in the lamination direction of said tube elements, wherein:

a first tank group is defined by said tanks connected along the lamination direction on one side of said tube elements, and said first tank group is partitioned with a partition member so as to define at least a first tank subgroup and a second tank subgroup located downstream of said first tank subgroup relative to the direction of fluid flow through said laminated tube elements;

a second tank group is defined by said tanks connected along the lamination direction on an opposite side of said tube elements relative to said tanks forming said first tank group;

a first odd fluid pass is defined by said tanks defining said first tank subgroup and the first half passages extending from said tanks defining said first tank subgroup;

an even fluid pass is defined by a first plurality of tanks of said second tank group, which are oppositely disposed relative to the tanks of said first tank subgroup, and the second half passages which extend from said first plurality of tanks of said second tank group;

a second odd fluid pass is defined by a second plurality of tanks of said second tank group and the second half passages extending from said second plurality of tanks of said second tank group;

a coolant intake structure is connected to said first tank subgroup;

a coolant outlet structure is connected to a downstream-most one of said tanks of said first and second tank groups;

said first odd fluid pass includes a first series of tanks disposed remote from an upstream most tank of said first tank subgroup, and a second series of tanks which includes said upstream-most tank of said first tank subgroup;

each of the communicating openings of said first series of tanks in said first tank subgroup has a smaller opening area than that defined by the communicating openings of said second series of tanks in said first tank subgroup;

a center of said opening areas of said first series of tanks in said first tanks subgroup each is lower than a center of said corresponding tank;

said second odd fluid pass includes a first series of tanks of said second plurality of tanks disposed remote from an upstream-most tank of said second plurality of tanks, and a second series of tanks which includes said upstream-most tank of said second plurality of tanks;

each of the communicating openings of said first series of tanks of said second plurality of tanks has a smaller opening area than that defined by the communicating openings of said second series of tanks of said second plurality of tanks; and a center of each opening area of said first series of tanks, in said first and second odd fluid passes, is at a lower position than a center of its corresponding tank.

16. A laminated heat exchanger as claimed in claim 15, wherein:

each one of said second series of tanks in said first tank subgroup is provided with a plurality of communicating openings in each wall in order to enlarge the opening area thereof relative to the opening areas of said first series of tanks of said first tank subgroup; and each of said first series of tanks of said first tank subgroup has a smaller number of communicating openings in each wall thereof in relation to the number of communicating openings in each wall of said second series of tanks so as to reduce the opening areas of said first series of tanks relative to the opening areas of said second series of tanks.

17. A laminated heat exchanger as claimed in claim 16, wherein:

each of said second series of tanks of said first tank subgroup is provided with two communicating openings in each wall thereof, with one of said two communicating openings disposed above the other of said two communicating openings; and each of said first series of tanks of said first tank subgroup has a single opening formed in a lower portion of at least one wall thereof.

18. A laminated heat exchanger as claimed in claim 17, wherein:

each of said upper communicating openings of said second series of tanks of said odd passes has an approximately semicircular shape with a chord at a lower portion thereof; and each of said communicating openings formed at said lower portions of said first and second series of tanks of said odd passes has an approximately semicircular shape with a chord at an upper portion thereof.

19. A laminated heat exchanger as claimed in claim 17, wherein each of said communicating openings of said first series of tanks in said odd passes has an oval shape.

20. A laminated heat exchanger as claimed in claim 15, wherein:

each of the opposing walls of said second series of tanks in said odd passes has a circular shape and is provided with a specific opening area having a center point coinciding with a center of said tank wall; and each of the opposing walls of said first series of tanks in said odd passes has a circular shape and is provided with an opening area which is smaller than said specific opening area and has a center point located below a center of said tank wall.

21. A laminated heat exchanger as claimed in claim 15, wherein:

said coolant intake structure is located approximately in the center of said first tank subgroup; and said coolant outlet structure is located approximately in the center of said second tank subgroup.

22. A laminated heat exchanger comprising:

a plurality of tube elements; and a plurality of fins alternately laminated to surfaces of said tube elements which are disposed adjacent to each other such that said tube elements are aligned along a lamination direction, each of said tube elements including a pair of tanks formed at one end with respect to a longitudinal direction thereof, a first half passage extending from one of said pair of tanks, a second half passage extending from the other of said pair of tanks, said first and second passages defining a U-shaped passage fluidly communicating between said tanks, and communicating holes formed in opposing walls of each of said tanks in the lamination direction of said tube elements, wherein:

a first tank group is defined by said tanks connected along the lamination direction on one side of said tube elements, and said first tank group is partitioned with a partition member so as to define at least a first tank subgroup and a second tank subgroup located downstream of said first tank subgroup relative to the direction of fluid flow through said laminated tube elements;

a second tank group is defined by said tanks connected along the lamination direction on an opposite side of said tube elements relative to said tanks forming said first tank group;

a first odd fluid pass is defined by said tanks defining said first tank subgroup and the first half passages extending from said tanks defining said first tank subgroup;

an even fluid pass is defined by a first plurality of tanks of said second tank group, which are oppositely disposed relative to the tanks of said first tank subgroup, and the second half passages which extend from said first plurality of tanks of said second tank group;

a second odd fluid pass is defined by a second plurality of tanks of said second tank group and the second half passages extending from said second plurality of tanks of said second tank group;

a coolant intake structure is connected to said first tank subgroup;

a coolant outlet structure is connected to a downstream-most one of said tanks of said first and second tank groups;

said first odd fluid pass includes a first series of tanks in said first tank subgroup disposed adjacent to said partition member, and a second series of tanks spaced from said partition member by said first series of tanks in said first tank subgroup;

each of the communicating openings of said first series of tanks in said first tank subgroup has a smaller opening area than that defined by said communicating openings of said second series of tanks in said first tank subgroup;

a center of said opening areas of said first series of tanks in said first tank subgroup each is lower than a center of said corresponding tank;

said second odd fluid pass includes a first series of tanks of said second plurality of tanks disposed remote from said first plurality of tanks of said second tank group, and a second series of tanks disposed adjacent to said first plurality of tanks of said second tank group;

each of the communicating openings of said first series of tanks of said second plurality of tanks has a smaller opening area than that defined by the communicating openings of said second series of tanks of said second plurality of tanks; and a center of each opening area of said first series of tanks is at a lower position than a center of said corresponding tank.

23. A laminated heat exchanger as claimed in claim 22, wherein:

each of said second series of tanks in said odd fluid passes is provided with a plurality of communicating openings in each wall in order to enlarge the opening area thereof relative to the opening areas of said first series of tanks of said first tank subgroup; and each of said first series of tanks of said odd fluid passes has a smaller number of communicating openings in each wall thereof in relation to the number of communicating openings in each wall of said second series of tanks so as to reduce the opening area of said first series of tanks relative to the opening area of said second series of tanks.

24. A laminated heat exchanger as claimed in claim 23, wherein:

each of said second series of tanks of said odd fluid passes is provided with two communicating openings in each wall thereof, with one of said two communicating openings disposed above the other of said two communicating openings; and each of said first series of tanks of said odd fluid passes has a single opening formed in a lower portion of at least one wall thereof.

25. A laminated heat exchanger as claimed in claim 24, wherein:

each of said upper communicating openings of said second series of tanks of said odd fluid passes has an approximately semicircular shape with a chord at a lower portion thereof; and each of said communicating openings formed at said lower portions of said first and second series of tanks of said odd fluid passes has an approximately semicircular shape with a chord at an upper portion thereof.

26. A laminated heat exchanger as claimed in claim 24, wherein each of said communicating openings of said first series of tanks of said odd fluid passes has an oval shape.

27. A laminated heat exchanger as claimed in claim 23, wherein:

each of the opposing walls of said second series of tanks in said odd fluid passes has a circular shape and is provided with a specific opening area having a center point coinciding with a center of said tank wall; and each of the opposing walls of said first series of tanks in said odd fluid passes has a circular shape and is provided with an opening area which is smaller than said specific opening area and has a center point located below a center of said tank wall.

28. A laminated heat exchanger as claimed in claim 22, wherein:

said coolant intake structure is located approximately in the center of said first tank subgroup; and said coolant outlet structure is located approximately in the center of said second tank subgroup.

* * * * *